United States Patent [19]

Hotomi et al.

[11] Patent Number: 5,027,157

[45] Date of Patent: Jun. 25, 1991

[54] DEVELOPING DEVICE PROVIDED WITH ELECTRODES FOR INDUCING A TRAVELING WAVE ON THE DEVELOPING MATERIAL

[75] Inventors: Hideo Hotomi; Yoshihisa Terasaka; Hiroshi Mizuno, all of Osaka, Japan

[73] Assignee: Minolta Camera Kabushiki Kaisha, Osaka, Japan

[21] Appl. No.: 446,799

[22] Filed: Dec. 1, 1989

[30] Foreign Application Priority Data

| | | | |
|---|---|---|---|
| Dec. 2, 1988 | [JP] | Japan | 63-306605 |
| Dec. 13, 1988 | [JP] | Japan | 63-314436 |
| Dec. 13, 1988 | [JP] | Japan | 63-314437 |
| Dec. 14, 1988 | [JP] | Japan | 63-316014 |
| Dec. 14, 1988 | [JP] | Japan | 63-316015 |

[51] Int. Cl.[5] ..... G03G 15/06; G03G 15/09

[52] U.S. Cl. ..... 355/261; 355/253; 355/259

[58] Field of Search ..... 355/245, 246, 251, 252, 355/253, 254, 261, 265; 118/653, 656, 657, 658

[56] References Cited

U.S. PATENT DOCUMENTS

| | | | |
|---|---|---|---|
| 3,233,587 | 2/1966 | Morton | 118/657 |
| 4,114,261 | 9/1978 | Weiler | 355/265 X |
| 4,282,303 | 8/1981 | Bergen | 118/653 X |
| 4,395,476 | 7/1983 | Kanbe et al. | 118/653 X |
| 4,515,106 | 5/1985 | Kohyama | 118/651 |
| 4,527,884 | 6/1985 | Nusser | 355/265 X |
| 4,558,941 | 12/1985 | Nosaki et al. | 355/265 X |
| 4,568,955 | 2/1986 | Hosoya et al. | 355/265 X |
| 4,598,991 | 7/1986 | Hosoya et al. | 355/265 X |
| 4,752,810 | 6/1988 | Schmidlin et al. | 355/303 |
| 4,774,591 | 10/1988 | Martin et al. | 118/653 X |
| 4,792,512 | 12/1988 | Haneda et al. . | |

FOREIGN PATENT DOCUMENTS

| | | | |
|---|---|---|---|
| 47-47811 | 12/1972 | Japan . | |
| 54-12667 | 5/1979 | Japan . | |
| 58-202217 | 11/1983 | Japan . | |
| 59-17559 | 1/1984 | Japan . | |
| 59-79266 | 5/1984 | Japan . | |
| 59-176755 | 10/1984 | Japan . | |
| 59-181371 | 10/1984 | Japan . | |
| 0181372 | 10/1984 | Japan | 355/265 |
| 59-189367 | 10/1984 | Japan . | |
| 61-189565 | 8/1986 | Japan . | |
| 63-13067 | 1/1988 | Japan . | |
| 63-13068 | 1/1988 | Japan . | |
| 0013078 | 1/1988 | Japan | 355/262 |

*Primary Examiner*—A. T. Grimley
*Assistant Examiner*—Nestor R. Ramirez
*Attorney, Agent, or Firm*—Burns, Doane, Swecker & Mathis

[57] ABSTRACT

A developing apparatus for developing an electrostatic latent image, which includes an electrostatic latent image holding member for holding an electrostatic latent image, a developing material support member provided to confront the electrostatic latent image holding member, and an electric field curtain generating device which functions as a developing material supply device for supplying the developing material to the developing material support member, and also causes an electric field curtain force in a form of a travelling wave travelling in terms of time, to act on the developing material.

13 Claims, 21 Drawing Sheets

DEVELOPING DEVICE PROVIDED WITH ELECTRODES FOR INDUCING A TRAVELING WAVE ON THE DEVELOPING MATERIAL

BACKGROUND OF THE INVENTION

The present invention generally relates to electrophotography and more particularly, to a developing apparatus for use in an electrophotographic apparatus and the like.

Conventionally, in a developing apparatus to be used in an electrophotographic apparatuses, etc., for electrically charging uncharged toner supplied into a developing apparatus thereof, it has been a common practice to charge the toner through depression thereof by a blade or the like, or through friction thereof with carrier and the like.

However, in the case where toner is adapted to be charged through contact by the blade or friction with respect to carrier, etc. as described above, there have been such problems that the toner may be crushed in some cases or that a considerable time is required for rising in the charging speed of toner, with a consequent poor response characteristic, while the charge amount of the toner is not stabilized in a proper range, thus resulting in fogging in the image to be formed or giving rise to scattering of toner.

In the arrangements which employ the electric field curtain device as referred to above, however, charging characteristics of toner have not yet been fully improved, with such problems as scattering of toner fogging due to insufficiently charged toner, etc. still being left unsolved.

SUMMARY OF THE INVENTION

Accordingly, a primary object of the present invention is to provide a developing apparatus for use in an electrophotographic apparatus or the like, which is capable of improving the charging characteristics of the developing material in the developing apparatus, and achieving a higher rising speed in the charging of the developing material, with simultaneous elimination of fogging in the formed images or soiling of images due to scattering of the developing material.

Another object of the present invention is to provide a developing apparatus of the above described type, which can improve charging characteristics of the developing material in the developing apparatus for a higher rising speed in the electrical charging of toner, with simultaneous stabilization of a charge amount of the toner within a proper range, thus eliminating undesirable scattering of toner or fogging in the images to be formed.

A further object of the present invention is to provide a developing apparatus having an electric field curtain device in which, contact charging characteristics of the developing material to be transported are improved, with a higher rising in the speed for transportation of the developing material.

Still another object of the present invention is to provide a developing apparatus having an electric field curtain device in which contact charging characteristics of the developing materials are improved, with suppression of deterioration of a piezoelectric element under a high humidity, while control of the transport amount or charge amount of the developing material may be readily effected.

In accomplishing these and other objects, according to the present invention, there is provided a developing apparatus for developing an electrostatic latent image, which includes an electrostatic latent image holding member for holding an electrostatic latent image; a developing material support member provided t confront said electrostatic latent image holding member; and an electric field curtain generating means which functions as a developing material supply means for supplying the developing material to said developing material support member, and also causes an electric field curtain force in a form of a travelling wave travelling in terms of time, to act on the developing material.

There is also provided according to the present invention, a developing apparatus for developing an electrostatic latent image, which includes an electrostatic latent image holding member for holding an electrostatic latent image; a developing material support member provided to confront said electrostatic latent image holding member and driven for rotation, and a developing material supply means having an opening portion at least at its one portion to confront said developing material support member and also, a plurality of insulated electrodes provided along a direction towards said opening, wherein means for impressing alternating voltage of at least more than two phases is connected across the neighboring ones of said electrodes for causing to act, an electric field curtain force in a form of a travelling wave travelling in terms of time towards said opening.

More specifically, according to a first aspect of the present invention, there is provided a developing apparatus which comprises a developing sleeve, and an electric field curtain device of two or more phases constituted by winding conductive wires and provided as means for transporting a developing material to said developing sleeve.

In the developing apparatus according to the above aspect of the present invention having the construction as described above, when the electric field curtain is caused to function by the electric field curtain device of two or more phases constituted by winding conductive wires, the developing material is charged by the action of the electric field curtain so as to be transported to the developing sleeve.

In a second aspect of the present invention, there is provided a developing apparatus which includes at least a developing material container for accommodating a developing material therein and a developing material transport section for transporting the developing material, and further comprises an electric field curtain device of two or more phases insulated from each other and a charging device for electrically charging the developing material which are provided at said developing material container.

In the above developing apparatus according to the present invention, when the charging device is operated together with the electric field curtain device of two or more phases insulated from each other and provided in the developing material container, the developing material accommodated within the developing apparatus is charged by the above charging device so as to act as a trigger, and by the action of the electric field curtain by the above electric field device, the developing material is quickly and uniformly charged by a proper charge amount.

In the third aspect of the present invention, there is provided a developing apparatus which includes a contact charging section for causing an uncharged developing material to be electrically charged through contact, a preliminary charging section for uniformly subjecting the developing material led from said contact charging section to preliminary electrical charging, a charge amount selecting section for selecting the developing material electrically charged in a proper amount by eliminating the developing material improperly charged in the developing material preliminarily charged in said preliminary charging section, and a charged particulate material transport section for transporting the developing material charged by the proper amount and selected by the charge amount selecting section, toward the developing side, and further, an electric field curtain device provided at least at said preliminary charging section.

In the developing apparatus for the third aspect of the present invention having the construction as described above, when the developing material slightly charged by the contact and friction at the contact charging section, is supplied to the preliminary charging section, this function acts as a trigger, and by the action of the above electric field curtain provided at the preliminary charging section, the developing material is to be preliminarily charged to the uniform and proper charge amount by the action of said electric field curtain.

Thus, of the developing material charged at the preliminary charging section, the developing material insufficient in the charge amount is removed at the charge amount selecting section, and only the developing material charged by the proper amount is selected to be led to the charged particulate material transport section so as to be further transported to the developing side by the charge particulate material transport section.

In a fourth aspect of the present invention, there is provided an electric field curtain device which comprises an electrode means to be applied with an alternating voltage to form a non-uniform alternating field, and a charge transport layer provided at a front face side thereof or transferring carrier injected from said electrode means.

In the above arrangement, for the charge transport layer, it is preferable to employ a layer having a displacing rate of carrier therethrough higher than $10^{-7}$ V·cm/sec., and for the charge transport material to be contained in the above layer, such a material as will transfer either electron or hole according to the charging polarity of the particulate material such as toner or the like to be transferred by this electric field curtain device.

In connection with the above, for the charge transport material as referred to above, there may be employed known compounds of hydrazone, oxidiazole, triphenylmethane, pyrazoline, styryl groups, etc., among which hydrazone compounds represented by a following general formula [1] is particularly preferable.

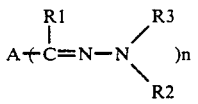

[1]

wherein R1 represents the hydrogen or methyl group, and R2 and R3 denote the alkyl group, arakyl group, aryl group which may have substitutional groups, or condensed polycyclic group which may have substitutional groups, and R2 and R3 may form rings by bonding. A represents the aromatic hydrocarbon group or aromatic heterocyclic group which may have substitutional groups, and n denotes a number for 1 or 2.

Meanwhile, for forming the charge transport layer through employment of the charge transport material as described above, it is a common practice to prepare such a layer by applying the charge transport material as referred to above, dispersed in an insulative resin for a bonding agent, with subsequent baking thereof.

Here, as the above insulative resin for the bonding agent, there may be employed all electrically insulative resin to be used for the bonding agent such as the thermo-plastic resin, thermo-setting resin, photo-setting resin or photo-conductive resin, etc. which are known in themselves.

Although not particularly limited to those as given hereinbelow, for the examples of proper resins for the bonding agent to be used, there may be employed thermo-plastic bonding agents such as saturated polyester resin, polyamide resin, acrylic resin, ethylene-vinyl acetate copolymer, ion crosslinked olefine copolymer (ionomer), styrene-butadiene block copolymer, polycarbonate, vinylchloride-vinyl acetate copolymer, cellulose ester, polyimide, etc., thermo-setting bonding agents such as epoxy resin, urethane resin, silicone resin, phenol resin, melamine resin, xylene resin, alkyd resin, thermo-setting acrylic resin, etc., photo-setting resins, photo-conductive resins such as poly-N-vinylcarbazole, polyvinyl pyrene, polyvinyl anthracene, etc.

It is desirable that the bonding agent resins as referred to above should have a volume resistance higher than $1\times10^{14}\Omega$ as measured independently.

It is to be noted that, for the charge transport material as described above, polyvinyl carbazole and polyvinyl anthracene, etc., which are of high polymer in themselves may be employed.

For providing such a charge transport layer on the electric field curtain device, it is normally so arranged that electrodes for the curtain device are provided on a dielectric layer so as to insulate the electrodes from each other, and the charge transport layer is formed on the front face side of said dielectric layer.

However, in the case where the charge transport layer itself has a high electrical resistance higher than $10^{10}\Omega$·cm, it may be so arranged to provide the electrodes directly in the charge transport layer.

Furthermore, it should preferably be so arranged that an electrically conductive layer is provided at the front face side of the above charge transport layer for the protection thereof, while a pulse bias voltage is applied to said conductive layer for causing the electric field to act on the charge transport layer, thereby to expedite injection of carrier into the charge transport layer and movement of the carrier within said charge transport layer, and also, to make the surface potential of the transported carrier uniform.

As described so far, in the electric field curtain device for the fourth aspect of the present invention, upon application of the alternating voltage to the electrodes thereof, non-uniform alternating field is formed, while carrier is injected into said charge transport layer, with said carrier being transferred toward the front face side through the charge transport layer.

Thus, when the particulate material such as toner and the like contacts the surface of the electric field curtain device in which the carrier is transferred in the above described manner, the particulate material is instantly strongly charged through contact by the carrier to act as a trigger, and by the action of the electric field curtain, the particulate material such as toner, etc., is quickly charged uniformly with the transport rising speed thereof being increased to a large extent.

In the fifth aspect of the present invention, there is provided an electric field curtain device including a plurality of electrodes insulated from each other and applied with an alternating voltage to form a non-uniform alternating field. The electric field curtain device further includes a piezoelectric element provided to contact said electrodes, and an amorphous carbon film provided at a front face side of said piezoelectric element.

For the above electrodes, electrically conductive materials such as copper, gold, aluminum, chromium, nickel, platinum, ITO (Indium Tin Oxide), carbon, etc., may be employed, while, for the materials to insulate the electrodes from each other, for example, synthetic resins, glass, insulating ceramics, etc. can be used.

For the above piezoelectric element, piezoelectric materials generally used, such as the known piezoelectric member, lithium niobate, etc. may be adopted.

When such a piezoelectric element is to be provided so as to contact the electrodes, said electrodes are normally provided to be exposed from the dielectric layer constituted by the insulating materials as referred to above, and the film of the piezoelectric element is formed on the dielectric layer in a manner to contact said electrodes.

Furthermore, as the amorphous carbon film to be provided on the surface side, a plasma organic polymer film containing at least hydrogen atoms (referred to as a-C film hereinafter) is to be employed, and it is more preferable to use a plasma organic polymer film particularly containing halogen atoms from the viewpoint of charging characteristics of the particulate material.

Here, for forming such an a-C film by the glow electrical discharge, it is so arranged that hydrocarbon gas, and halogen compound gas depending on necessity, are employed as a row gas, while as a carrier gas, normally used hydrogen gas or argon gas, etc., may be used.

With respect to the state of phase for the hydrocarbon gas, it need not necessarily be in a gaseous phase under ordinary temperature and pressure, but may be in a liquid phase or solid phase so long as it can be vaporized through melting, evaporation, sublimation, etc. by heating or pressure reduction, etc.

For the hydrocarbon in the above hydrocarbon gas, there may be employed, for example, saturated hydrocarbon, unsaturated hydrocarbon, alicyclic hydrocarbon, aromatic hydrocarbon, etc.

Here, although many kinds of hydrocarbon can be employed, there may be employed, for example, methane, ethane, propane, butane, pentane, hexane, heptane, octane, isobutane, isopentane, neopentane, isohexane, neohexane, dimethyl butane, methylhexane, ethyl pentane, dimethy pentane, triptane, methylheptane, dimethyl hexane, trimethyl pentane, isonanon, etc. for the saturated hydrocarbon.

Meanwhile, for the unsaturated hydrocarbon, there may be used, for example, ethylene propylene, isobutylene, butene, pentene, methylbutene, hexene, tetramethyl ethylene, heptene, octene, allene, methylallene, butadiene, pentadiene, hexadiene, cyclopentadiene, ocimene, alloocimene, myrcene, hexatriene, acetylene, diacetylene, methylacetylene, butyne, pentyne, hexine, heptyne, and octyne, etc.

Similarly, for the alicyclic hydrocarbon, for example, cyclopropane, cyclobuthane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, fenchene, cyclofechene, tricyclene, bisabolene, zingiberene, curcumin, humulene, cadinene sesquibenihene, selinene, caryophyllene, santalene, cedrene, camphorene, phyllocladene, podocarprene, and mirene, etc. are employed.

For the aromatic hydrocarbon, there may be adopted, for example, benzene, toluene, xylene, hemimellitene, pseudocumene, mesitylene, prehnitene, isodurene, durene, pentamethyl benzene, hexamethyl benzene, ethylbenzene, propylbenzene, cumene, stylene, biphenyl, terphenyl, diphenylmethane, triphenylmethane, dibenzyl, stilbene, inden, naphthalene, tetralin, anthracene, phenanthrene, etc.

Here, the amount of hydrogen atoms contained in the above a-C film is about 30 to 60 atomic % with respect to the total amount of carbon atoms and hydrogen atoms.

Meanwhile, the amount of hydrogen atoms contained in the a-C film varies by the form of the film forming device and conditions during film formation, and examples for the cases where the hydrogen amount is reduced may be related to the cases in which temperature of the substrate is raised, pressure is reduced, dilution rate of raw hydrocarbon gas is lowered, raw gas having a low hydrogen content is used, higher power is impressed, frequency of alternating field is lowered, and d.c. field strength superposed to the alternating field is raised, etc.

In the fourth aspect of the present invention, besides the hydrocarbon gas referred to above, halogen compounds are employed for the raw gas, and it is preferable to arrange to add at least halogen atom in the a-C film.

The halogen atom may be any of fluorine atom, chlorine atom, bromine atom or iodine atom, and the state of phase in the above halogen compound gas need not necessarily be of a gaseous phase under ordinary temperature and phase, but may be of a liquid phase or solid state so long as it can be vaporized through melting, evaporation, sublimation, etc., by heating or pressure reduction, etc.

For the halogen compounds referred to above, there may be employed, for example, inorganic compounds such as fluorine, chlorine bromine, iodine, hydrogen fluoride, chlorine fluoride, bromine fluoride, iodine fluoride, hydrogen chloride, bromine chloride, iodine chloride, hydrogen bromide, iodine bromide, hydrogen iodide, etc., and organic compounds such as halogenated alkyl, alkyl metal halide, halogenated allyl, halogenated silicate, halogenated styrene, halogenated polymethylene, halogen-substituted organosilane, and haloform, etc.

Here, for the halogenated alkyl, there may be used, for example, methyl fluoride, methyl chloride, methyl bromide, methyl iodide, ethyl fluoride, ethyl chloride, ethyl bromide, ethyliodide, propyl fluoride, propyl chloride, propyl iodine, butyl fluoride, butyl chloride, butyl bromide, butyl iodine, amyl fluoride, amyl chloride, amyl bromide, amyl iodide, hexyl fluoride, hexyl chloride, hexyl bomide, hexyl iodide, butyl fluoride, heptyl chloride, heptyl bromide, heptyl iodide, etc.

Meanwhile, for the alkyl-metal halide, there may be employed, for example, dimethyl aluminum chloride, dimethyl aluminum bomide, dimethyl aluminum chloride, dimethyl aluminum iodide, methyl aluminum dichloride, methyl aluminum dibromide, methyl aluminum diiodide, trimethyl tin chloride, trimethyl tin bromide, trimethy tin iodide, trimethyl tin chloride, trimethyl tin bromide, dimethyl tin dichloride, dimethyl tin dibromide, dimethyl tin diiodide, diethyl tin dichloride, diethyl tin dibromide, diethyl tin diiodide, methyl tin trichlofide, methyl tin tribromide, methyl tin triiodide, thyl tin tribromide, etc.

For halogenated allyl, for example, fluorobenzene, chlorobenzene, bromobenzene, iodobenzene, chlorotoluene, bromotoluene, chloronaphthalene, and bromonaphthalene, etc. may be employed.

Meanwhile, for the halogenated silicate, there may be adopted, for example, monomethoxy trichlorosilane, dimethoxy dichlorosilane, trimethoxy monochlorosilane, monoethoxy trichlorosilane, diethoxy dichlorosilane, triethoxy monochlorosilane, monoaryloxy trichlorosilane, diaryloxy dichlorosilane, triaryloxy monochlorosilane, etc.

Similarly, for halogenated styrene, for example, chlorostyrene, bromostyrene, iodostyrene, and fluorostyrene, etc. may be used.

For halogenated polymethylene, there may be employed, for example, methylene chloride, methylene bromide, methylene iodide, ethylene chloride, ethylene bromide, ethylene iodide, trimethylene chloride, trimethylene bromide, trimethylene iodide, butane dichloride, butane dibromide, butane diiodide, pentane dichloride, pentane dibromide, pentane diiodide, hexane dichloride, hexane dibromide, hexane diiodide, heptane dichloride, heptane dibromide, heptane diiodide, octane dichloride, octane dibromide, octane diiodide, nonane dichloride, nonane dibromide, etc.

Meanwhile for the halogen-substituted organosilane, those which may be employed are, for example, chloromethyl trimethyl silane, dichloromethyl trimethyl silane, bis-chloromethyl dimethy silane, trichloromethyl methyl silane, chloroethyl- triethyl silane, dichloroethyl trethylsilane, bromoethyl trimethyl silane, iodomethyl trimethyl silane, bis-iodiomethyl dimethyl silane, chlorophenyl trimethyl silane, bromophnyl trimethyl silane, chlorophenyl triethyl silane, bromophenyl triethylsilane, chlorophnyl triethyl silane, bromophenyl triethyl silane, iodophnyl triethyl silane, etc.

For haloform, for exmaple, fluoroform, chloroform, bromoform, and iodoform, etc. may be used.

Here, the amount of halogen atom which is to be contained in the a-C film as a chemical modifier, may be mainly controlled by increasing or decreasing the amount of introduction of the halogen compound gas to be led to a reaction chamber for effecting the plasma reaction. More specifically, if the amount of introduction of the halogen compound gas is increased, the amount of addition of halogen atoms in the a-C film is increased, while conversely, if the amount of introduction of the halogen compound is decreased, the amount of addition of halogen atoms in the a-C film is decreased.

In connection with the above, the halogen atom content in the a-C film may be more than one atomic %, and, although the maximum content thereof is not particularly limited, it is necessarily limited by the manufacturing aspects such as construction of the a-C film and glow discharge.

It is to be noted here that, in the above embodiment, the thickness of the a-C film should preferably be in the range of 0.01 to 5 μm. In other words, if the thickness of the a-C film is less than 0.01 μm, the piezoelectric element provided below said film tends to be readily affected by the humidity, thus making it impossible to achieve a favorable moisture resistance, while, in the case where the film thickness is larger than 5 μm, there is a possibility that the adhesion of the film with respect to the piezoelectric element is undesirably deteriorated.

It should also be noted that, if it is so arranged to effect a polarity control by doping atoms of IIIA group or VA group in the a-C film, it becomes possible to effect property control according to the kinds of contacting particulate materials such as toner or the like, and when oxygen or nitrogen is doped in the a-C film, stability of characteristics against aging with time of the a-C film may be improved.

In the electric field curtain device in the fifth aspect of the present invention having the construction as described above, when an alternating voltage is applied to the plurality of electrodes insulated from each other, the non-uniform alternating field is produced, while the piezoelectric element provided to contact the above electrodes is caused to vibrate, and the particulate material such as toner is transported by the action of the field curtain due to the non-uniform alternating electric field and the vibration of the piezoelectric element.

In the above electric curtain device according to the present invention, since the contact electric field of the amorphous carbon film provided at the front face side is very high as compared with that of other substances, when a particulate material such as toner, etc. contacts said film, it is instantly strongly charged by the contact, with the rising speed for the transport of the particulate material being markedly increased.

Moreover, when the amorphous carbon film is doped by halogen atoms, since the amorphous carbon film has a water repellency and is superior in the moisture resistance, deterioration of the piezoelectric element under a high humidity or deterioration of the particulate material such as toner or the like by the leakage in the piezoelectric element may be suppressed by covering said piezoelectric element with the amorphous carbon film.

Furthermore, by doping such amorphous carbon film with proper atoms, it becomes possible to control the transport amount and the charge amount of the particulate material.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
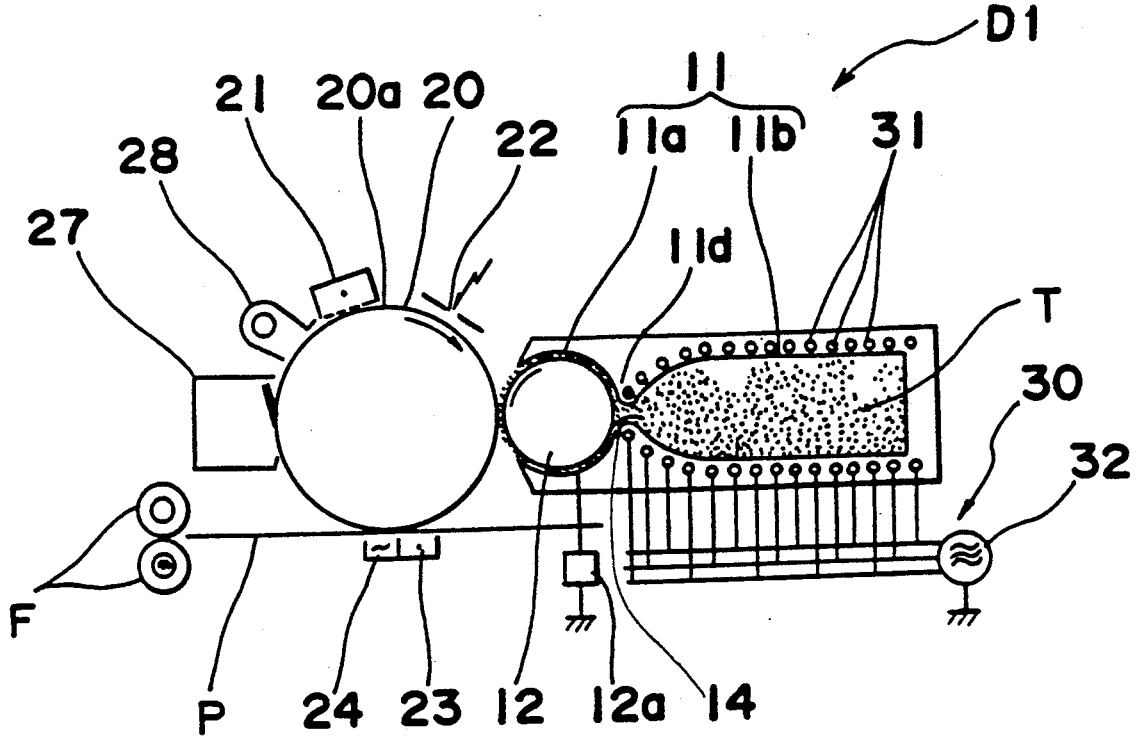
FIG. 1 is a schematic side sectional view showing a state of operation of a developing apparatus D1 according to one preferred embodiment of the present invention.

Before the description of the present invention proceeds, it is to be noted that like parts are designated by like reference numerals throughout the accompanying drawings, with detailed description thereof being abbreviated for brevity.

EMBODIMENT 1

Referring now to the drawings, there is shown in FIG. 1, a developing apparatus D1 according to a first embodiment of the present invention, which generally includes an apparatus main body 11 made of an insulating material such as polycarbonate or the like, and having a sleeve accommodating section 11*a* confronting a photosensitive surface 20*a* of a photoreceptor drum 20 rotating in a direction indicated by an arrow and a developing material accommodating section 11*b* containing a developing material T communicated with said sleeve accommodating section 11*a* through a narrow or bottle-neck portion 11*d*, a developing sleeve 12 rotatably provided within said sleeve accommodating section 11*a*, and an electric field curtain device 30 provided for the developing material accommodating section 11*b* except for the sleeve accommodating section 11*a* as illustrated.

Figure 2:
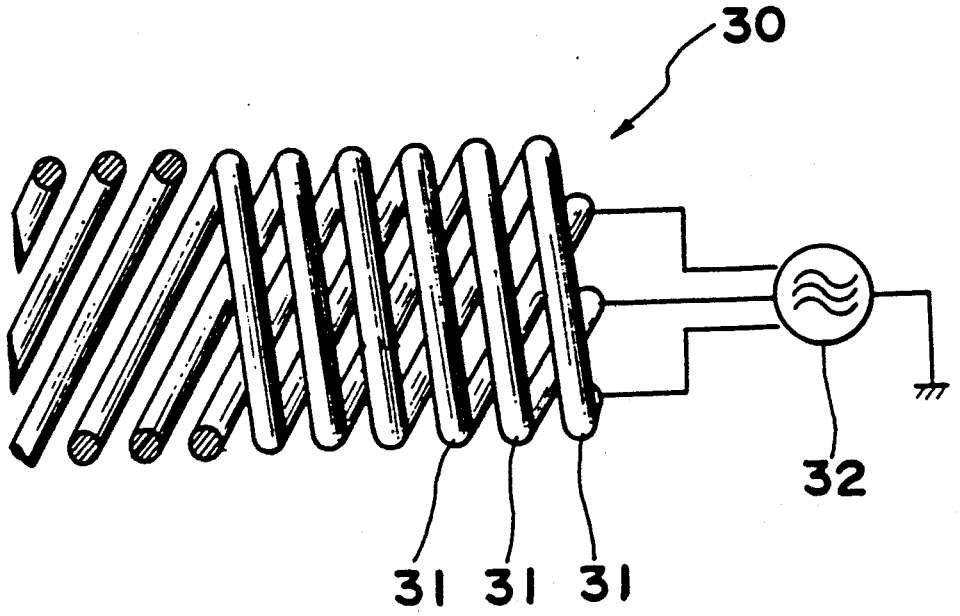
FIG. 2 is a fragmentary side elevational view partly in section, showing on an enlarged scale, coils for an electric field curtain device employed in the arrangement of FIG. 1.

For the electric field curtain device 30 referred to above, conductor wires 31 made of a conductive material such as copper, aluminum, iron, nickel, zinc, gold or the like are wound into coils in three phases as shown in FIG. 2, so as to be accommodated within a wall material for the developing material accommodating section 11*b*, with respective turns of the conductor wires 31 being connected to a three phase alternating voltage source 32 of a Y-connection.

Thus, alternating voltages deviated in phase by $\frac{2}{3}\pi$ are respectively applied to the conductive wires 31 from said three phase alternating voltage source 32, thereby to form a travelling wave alternating non-uniform electric field row within the developing material accommodating section 11*b*, and by the action of this electric field curtain, the developing material T accommodated within the section 11*b* is electrically charged, and transported to the sleeve accommodating section 11*a* containing the developing sleeve 12 therein for supplying the developing material to said sleeve 12.

Subsequently, development to be effected by supplying the developing material to the surface 20*a* of the photoreceptor drum 20 through employment of the developing apparatus D1 as referred to above, will be explained.

In the first place, the photosensitive surface 20*a* of the photoreceptor drum 20 is preliminarily charged by a corona charger 21, and light is projected over the surface of the photoreceptor drum thus charged through a slit 22 so as to form an electrostatic latent image on the surface of said photoreceptor drum.

Thereafter, a developing bias voltage 12*a* is applied to the developing sleeve 12 supplied with the developing material T as described above, and the developing material T is fed onto the portion of the electrostatic latent image formed on the surface of the photoreceptor drum 20, and thus, a toner image is formed on the surface of said photoreceptor drum 20.

Then, the toner image thus formed on the transferred onto a recording paper sheet P through a transfer corona charger 23 and a separting charge eraser 24 so as to be fixed onto the recording paper sheet by a set of fixing rollers F, while the developing material T remaining on the surface 20*a* is removed by a cleaner unit 27, and then, the surface 20*a* is erased in the electrical charge by an eraser lamp 28.

On the other hand, the developing material T remaining on the developing sleeve 12 without being fed to the photoreceptor drum 20, is arranged to be again led into the developing material accommodating section 11*b* by a scraper 14 provided in the narrow portion 11*d* in the apparatus main body 11.

Figure 3:
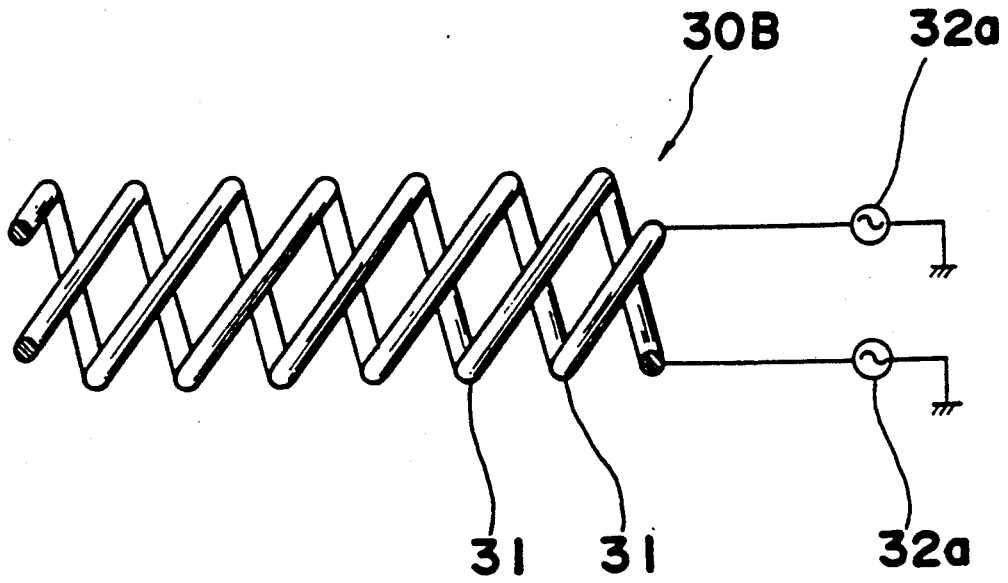
FIG. 3 is a view similar to FIG. 2, which particularly shows a modification thereof.

It should be noted here that, in the above embodiment, although conductor wires 31 wound into the three phases are employed for the electric field curtain device 30, the arrangement may be so modified, for example as in an electric field curtain device 30B shown in FIG. 3, that conductor wires 31 are would into two phases, with the respective conductor wires 31 being connected to alternating voltage sources 32*a*, whereby alternating voltages deviated in phase $\pi/2$ are applied to the respective conductor wires 31 from said voltage sources 32*a* for causing the electric field curtain to act so as to charge the developing material T contained in the developing material accommodating section 11*b*, thereby to transport said developing material toward the developing sleeve 12.

EMBODIMENT 2

Figure 4:
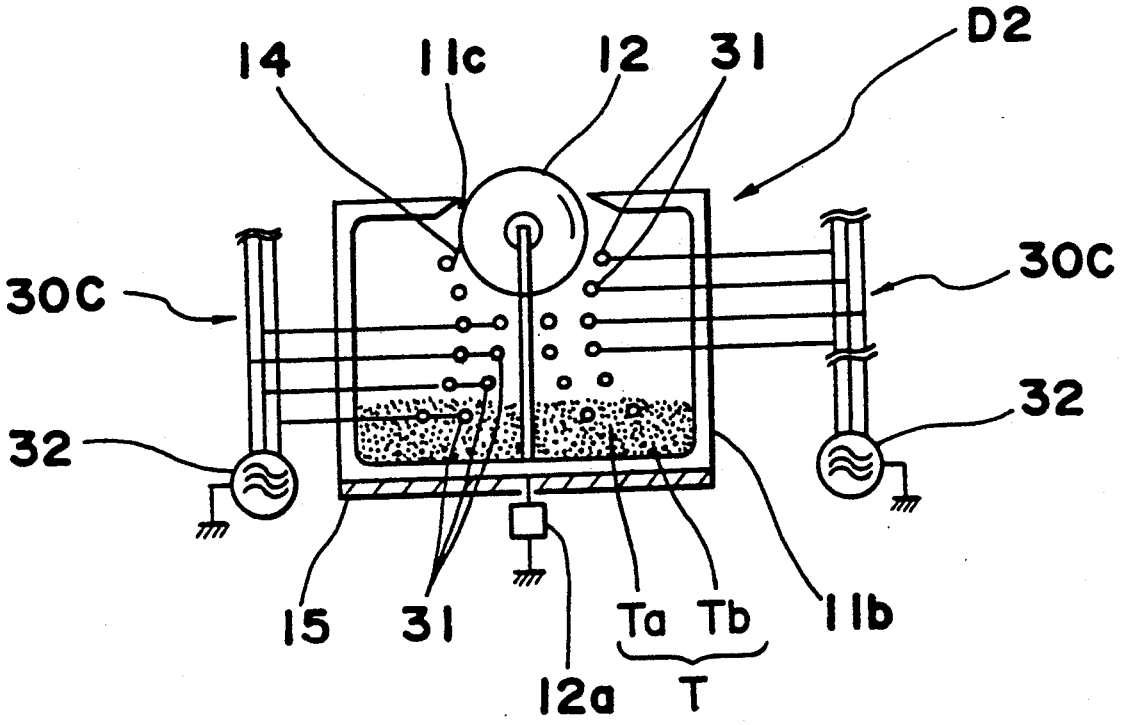
FIG. 4 is a schematic side sectional view of a developing apparatus D2 according to a second embodiment of the present invention.

A developing apparatus D2 according to a second embodiment of the present invention shown in FIG. 4, includes a developing material accommodating section 11*b* in a rectangular box-like configuration having an opening 11*c* in its upper wall, a developing sleeve 12 rotatably disposed adjacent to said opening 11*c* within the section 11*b* so as to be partially projected above said upper wall, and electric field curtain devices 30*c* provided in said section 11*b* in which the developing material T is accommodated.

In the above embodiment, each of the electric field curtain devices 30C includes conductor wires 31 wound into three phases, and the turns of the conductor wires 31 thus wound into three phases are provided in a double structure at inner and outer sides, while alternating voltages deviated in phase by $\frac{2}{3}\pi$ are applied to respective conductor wires 31 in the three phase winding from three phase alternating voltage sources 32 of the Y-connection, whereby the electric field curtain is acted in the developing material accommodating section 11*b* respectively by the electric-field curtain devices 30C provided in a double structure for the inner and outer sides, so as to supply the developing material T to the developing sleeve 12.

It is to be noted here that, in the developing apparatus D2 as described above, a developing material containing carrier Tb besides toner Ta is employed, and an attracting magnet. 15 is provided at the bottom portion of the section 11*b* for preventing the carrier Tb from scattering. In the above embodiment, a scraper 14 is provided, at the upper left portion in the section 11*b*, so as to contact the surface of the developing sleeve 12.

EMBODIMENT 3

Figure 5:
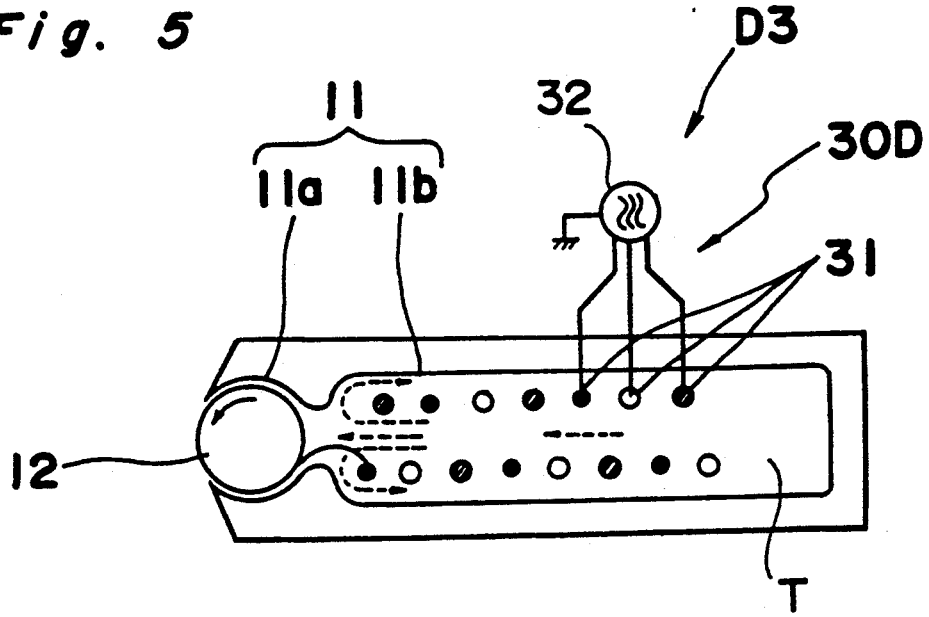
FIG. 5 is a schematic side sectional view of a developing apparatus D3 according to a third embodiment of the present invention.

In a developing apparatus D3 according to a third embodiment of the present invention as shown in FIG. 5, in a similar manner as in the developing apparatus D1 for the first embodiment, the developing sleeve 12 is accommodated within the sleeve accommodating section 11*a* of the apparatus main body 11, while an electric field curtain device 30D is provided in the developing material accommodating section 11*b* of the apparatus main body 11 except for the sleeve accommodating section 11*a*.

Figure 6:
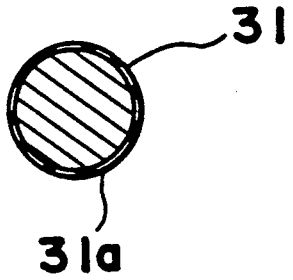
FIG. 6 is a cross sectional view, on an enlarged scale, of a coil employed in the arrangement of FIG. 5.

In the above embodiment, for the electric field curtain device 30D, conductor wires 31 each covered on the surface thereof with an insulative film 31*a* of enamel or the like as shown in FIG. 6 are employed, and such conductor wires 31 are wound in three phases so as to be provided within said developing material accommodating section 11*b* in which the developing material T is accommodated, with the respective conductor wires 31 being connected to an alternating voltage source 32 in the Y-connection.

Thus, alternating voltages deviated in phase by $\frac{2}{3}\pi$ are respectively applied to the conductive wires 31 from said three phase alternating voltage source 32, thereby to form a travelling wave alternating non-uniform electric field row within the developing material accommodating section 11*b*, and by the action of this electric field curtain, the developing material T accommodated within the section 11*b* is electrically charged, and transported to the sleeve accommodating section 11*a* containing the developing sleeve 12 therein for supplying the developing material to said sleeve 12.

Here, in the developing apparatus D3 as described above, if it is so arranged that the action of the electric field curtain becomes weaker as the developing sleeve 12 approached, by winding the respective conductor wires 31 from a close winding to a rough winding following the approach towards the side of the developing sleeve 12, or by winding the conductor wires 31 in a multiple layers in a position spaced from the developing sleeve 12, and in a single layer in the position near said sleeve 12, undesirable staying or stagnation of the developing material T to be transported towards the developing sleeve 12 by the action of the electric field curtain may be reduced.

Figure 7:
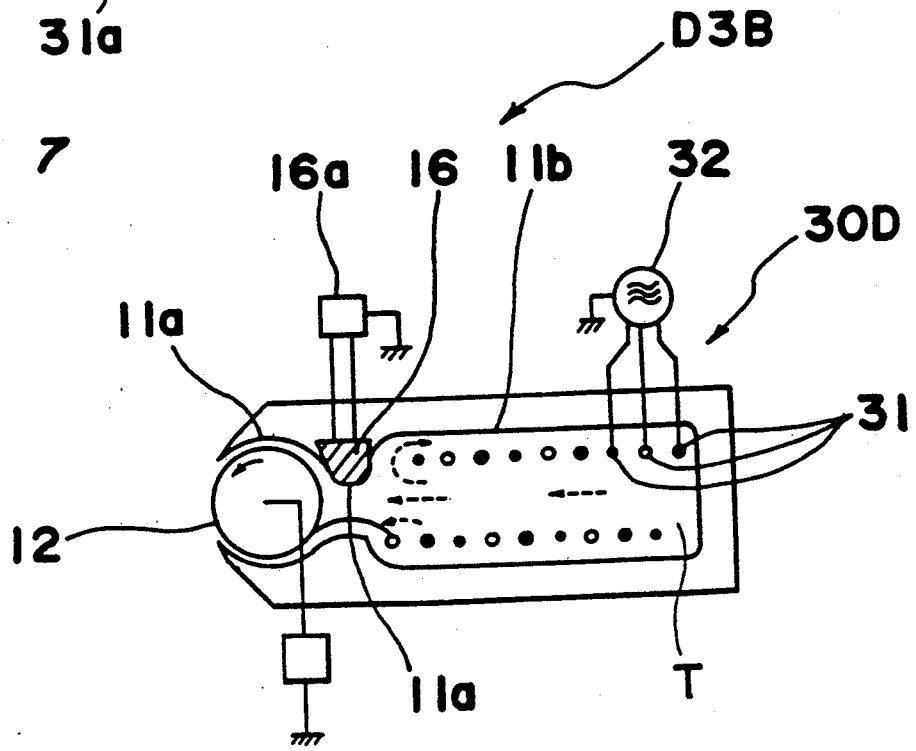
FIG. 7 is a schematic side sectional view of a developing apparatus D3B according to a modification of the arrangement of FIG. 5.

Moreover, in order to further reduce the stagnation of the developing material T to be transported to the developing sleeve 12 as referred to above, it may be so arranged, as shown in a modified developing apparatus D3B in FIG. 7, that a vibrating element 16 made of a piezoelectric element such as a bimorph, unimorph, monomorph type or the like is provided at the narrow or bottle-neck portion 11*d* between the developing material accommodating section 11*b* and the sleeve accommodating section 11*a*, and by applying voltage to said vibrating element 16 from a vibrating element driving power source 16*a* for vibration of said vibrating element 16, the stagnation of the developing material T is reduced.

EMBODIMENT 4

Figure 8:
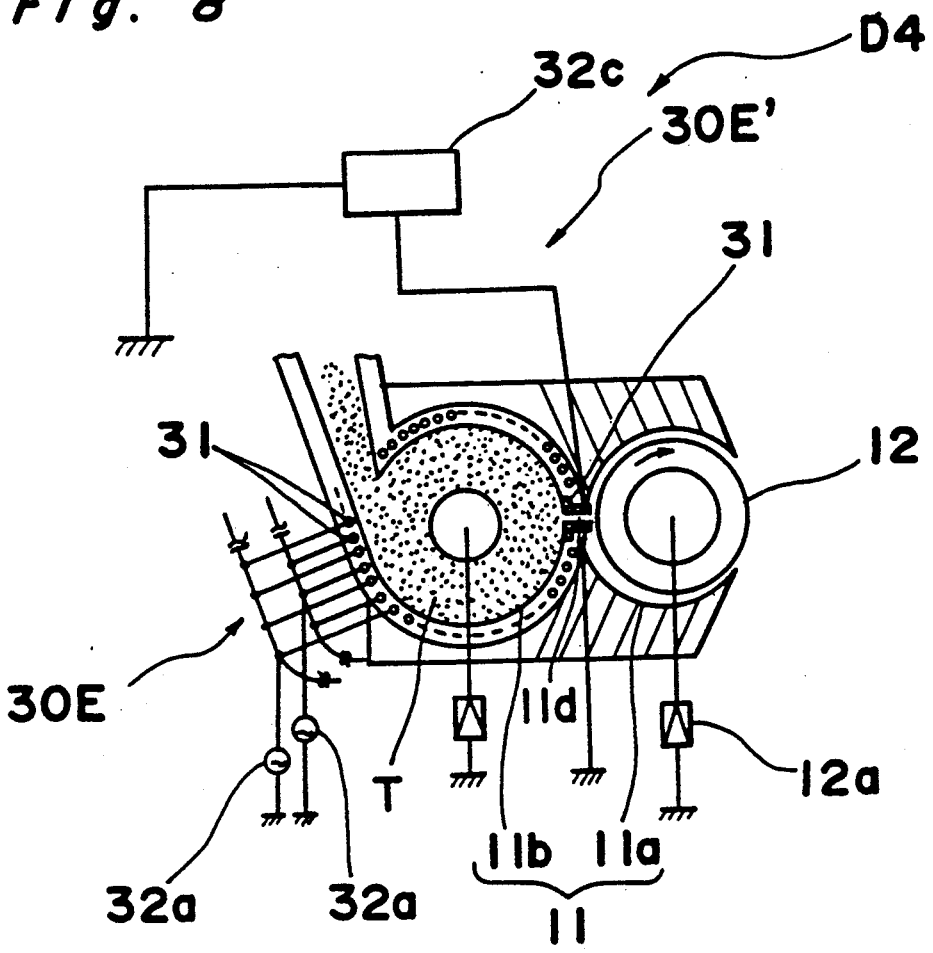
FIG. 8 is a schematic side sectional view of a developing apparatus D4 according to a fourth embodiment of the present invention.

In a developing apparatus D4 according to a fourth embodiment of the present invention also, as shown in FIG. 8, the developing sleeve 12 is accommodated within the sleeve accommodating section 11*a* of the apparatus main body 11, while an electric field curtain device 30E is provided in the developing material accommodating section 11*b* of the apparatus main body 11 except for the sleeve accommodating section 11*a*.

For the electric field curtain device 30E referred to above, conductor wires 31 are wound into two phases so as to be accommodated within a wall material for the developing material accommodating section 11*b*, with respective turns of the conductor wires 31 being connected to alternating voltage sources 32*a*.

Thus, alternating voltages deviated in phase by $\pi/2$ are respectively applied to the conductive wires 31 from said the respective alternating voltage sources 32*a*, thereby to form a travelling wave alternating non-uniform electric field row within the developing material accommodating section 11*b*, and by the action of this electric field curtain, the developing material T accommodated within the section 11*b* is electrically charged for transportation.

Moreover, in the above developing apparatus D4 also, another electric field curtain device 30E' is provided at a narrow portion 11*d* between the developing material accommodating section 11*b* containing the developing material T and the sleeve containing section accommodating the developing sleeve 12, and windings of the conductor wires 31 are provided within the wall material at said narrow portion 11*d*, with the conductor wires 31 being connected to the alternating voltage source 32*c*.

Thus, the alternating voltage is applied to said conductor wires 31 from the voltage source 32*c* for causing an electric field curtain to act so as to feed the developing material T contained in the developing material accommodating section 11*b* to the developing sleeve 12 through the gap at said narrow portion 11*d*, which is set at 1.5 mm in this embodiment.

EMBODIMENT 5

Figure 9:
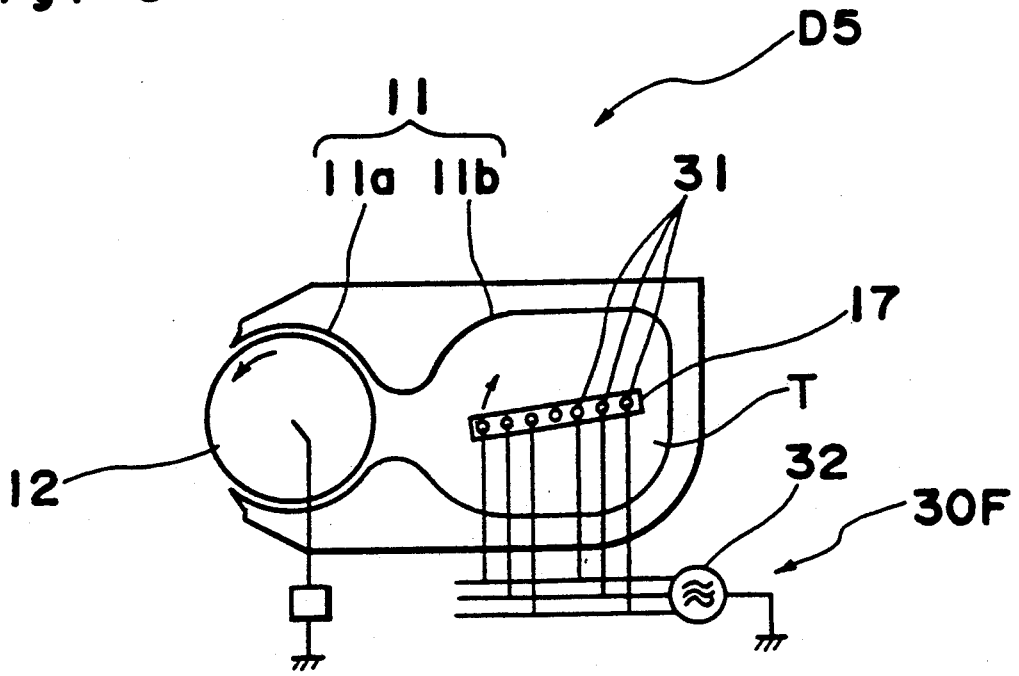
FIG. 9 is a schematic side sectional view of a developing apparatus D5 according to a fifth embodiment of the present invention.

In a developing apparatus D5 according to a fifth embodiment of the present invention, as shown in FIG. 9, the apparatus main body 11 is also divided into the sleeve accommodating section 11*a* in which the developing sleeve 12 is accommodated, and the developing material accommodating section 11*b* in which a stirring member 17 for stirring the developing material T through rotation is disposed, with said stirring member 17 being provided with an electric field curtain device 30F.

Here, for providing the curtain device 30F in said stirring member 17, conductor wires 31 are wound into three phases, while the respective turns of the conductor wires 31 are connected to the three phase alternating voltage source 32 of a Y-connection Thus, upon rotation of said stirring member 17, three phase alternating voltages respectively deviated in phase by $\frac{2}{3}\pi$ are applied to the respective conductor wires 31 provided in the stirring member 17, from said three phase alternating voltage source 32 so as to cause an electric field curtain to act, whereby through rotation of the stirring member 17 and the electric field curtain thus formed, the developing material contained in the section 11*b* is electrically charged so as to be transported to the sleeve accommodating section 11*a*, and thus, the developing material 13 is supplied to the developing sleeve 12.

EMBODIMENT 6

Figure 10:
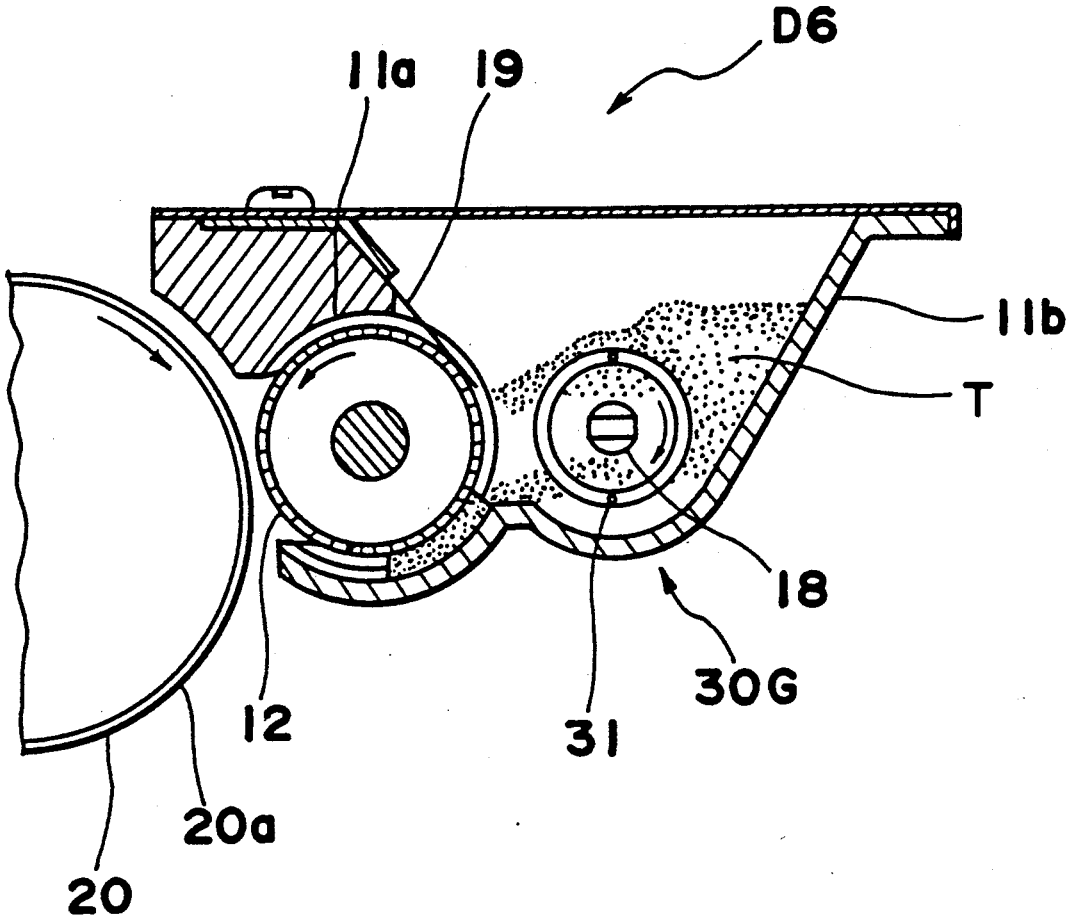
FIG. 10(A) is a schematic side sectional view of a developing apparatus D6 according to a sixth embodiment of the present invention.
FIG. 10(B) is a fragmentary perspective view showing a state of winding of a coil employed therein.
Figure 10:
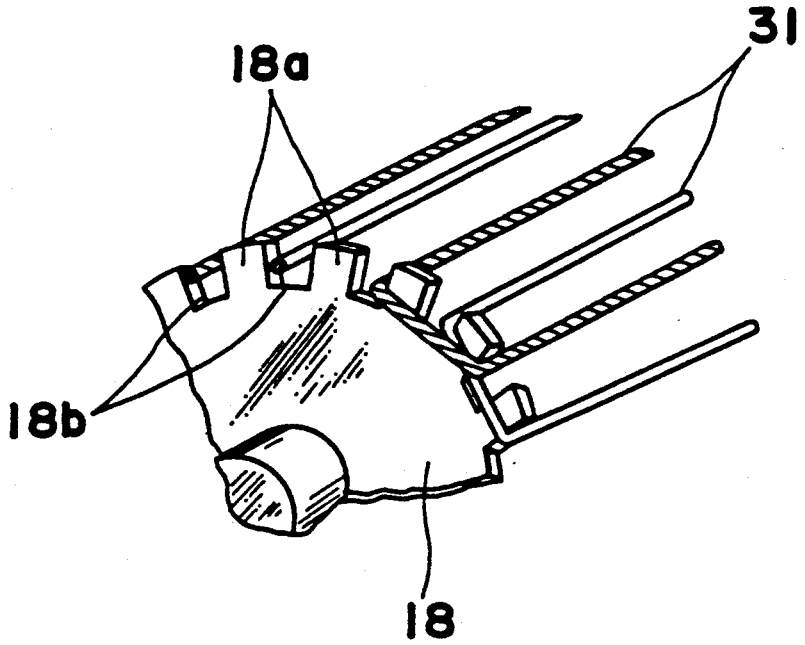

In a developing apparatus D6 according to a sixth embodiment of the present invention as shown in FIG. 10(A), the developing sleeve 12 is rotatably accommodated in a sleeve accommodating section 11*a*, while a rotary member 18 is provided for rotation in a developing material accommodating section 11*b*, with an electric field curtain device 30G being provided on said rotary member 18.

As shown in FIG. 10(B), for providing the electric field curtain device 30G on the rotary member 18, conductor wires 31 are wound through recesses 18*b* between teeth portions 18*a* formed in the outer periphery of the rotary member 18, while alternating voltage is applied to the conductor wires 31 from an alternating voltage source (not shown).

Thus, by rotating the rotary member 18, with simultaneous actuation of the electric field curtain device 30G, through rotation of the rotary member 18 and the action of the electric field curtain, the developing material T accommodated in the developing material accommodating section 11*b* is electrically charged so as to be transported to the developing sleeve 12.

Thus, the developing material 13 supplied to the developing sleeve 12 is depressed onto the surface of said developing sleeve 12 by a blade 19 provided on the upper portion of the apparatus housing so as to be held in pressure contact with the developing sleeve 12, and thus, the developing material on the sleeve 12 is restricted in its amount, and further charged through contact so as to be fed therefrom onto the photoreceptor drum 20.

Subsequently, as test examples 1 to 4, through employment of the developing apparatuses for the foregoing embodiments 1 to 4, charge amount of the developing material T fed onto the respective developing sleeve 12 was measured, with results as follows.

TEST EXAMPLE 1

Through employment of the developing apparatus D1 in FIG. 1 for the first embodiment described earlier, alternating voltages respectively deviated in phase, with a frequency of 300 HZ and a peak to peak value of voltage Vp-p at 1.1 KV were applied from the three phase alternating voltage source 32 to the respective conductor wires 31 provided within the wall material to the developing material accommodating section **11*b* so as to cause the electric field curtain to act, thereby to supply the developing material T accommodated within the developing material accommodating section 11*b* onto the developing sleeve 12**.

Here, for the developing material T, 100 weight parts of styrene-acrylic copolymer (softening point 132° C., glass transition point 60° C.), 5 weight parts of carbon black (MA#8, name used in trade and manufacture by Mitsubishi chemical Industries, Ltd., Japan) and 3 weight of nigrosine dye (Bontoron N-O1, name used in trade and manufactured by Orient Chemical Co., Ltd. Japan) were sufficiently mixed by a ball mill so as to be kneaded on three rolls heated up to 140° C., and after being left for cooling, the mixture was roughly ground through employment of a feather mill so as to be further pulverized by a jet mill, and classified by wind to obtain positively charging toner with an average particle diameter of 13 μm for use in the developing material.

TEST EXAMPLE 2

Through employment of the developing apparatus D2 in FIG. 4 for the second embodiment described earlier, alternating voltages respectively deviated in phase, with a frequency of 400 HZ and a peak to peak value of voltage Vp-p at 900 V were applied from the three phase alternating voltage source 32, to the respective three-phase wound conductor wires 31 provided in a double structure within the wall material of the developing material accommodating section **11*b* so as to cause the electric field curtain to act, thereby to supply the developing material T accommodated within the developing material accommodating section 11*b* onto the developing sleeve 12**.

Here, for the developing material T, a two-component developing material including toner Ta and carrier Tb was employed.

For the toner Ta, toner of a positive charging characteristic similar to that used in the above test example 1 was employed, while as carrier Tb, there was used magnetic carrier prepared by sufficiently mixing and grinding, with a Henschel mixer, 100 weight parts of polyester resin (softening point 123° C., glass transition point 65° C., AV 23, OHV 40), 500 weight parts of inorganic magnetic powder (EPT-1000, name used in trade and manufactured by Toda Industries Limited) and 2 weight parts of carbon black (MA#8 referred to earlier), and then, melting and kneading the mixture by an extruding kneader set at temperatures of 180° C. at a cylinder portion and at 170° C. at a cylinder head portion for subsequent cooling and pulverization by a jet mill, and thereafter, classifying the fine particles through employment of a classifier to obtain the magnetic carrier with an average particle diameter of 55 μm.

TEST EXAMPLE 3

For the test example 3, the developing apparatus D3 for the third embodiment of the present invention as referred to earlier was employed.

Then, for the test, alternating voltages respectively deviated in phase, with a frequency of 300 HZ and a peak to peak valve of voltage Vp-p at 900 V were applied from the three phase alternating voltage source 32 to the respective conductor wires 31 provided within the developing material accommodating section **11*b* so as to cause the electric field curtain to act, thereby to supply the developing material T accommodated within the developing material accommodating section 11*b* onto the developing sleeve 12**.

Here, for the developing, material T, 100 weight parts of polyester resin (softening point 130° C., glass transition point 60° C. AV 25, OHV 38), 5 weight parts of carbon black (MA#8, referred to earlier) and 3 weight parts of dye (Spiron black TRH, name used in trade and manufactured by Hodogaya Chemical Co., Ltd.) were sufficiently mixed by a ball mill so as to be kneaded on three rolls heated up to 140° C., and after being left for cooling, the mixture was roughly ground through employment of a feather mill so as to be further pulverized by a jet mill, and classified by wind to obtain negatively charging tone with an average particle diameter of 13 μm for use in the developing material.

TEST EXAMPLE 4

Through employment of the developing apparatus D4 in FIG. 8 for the fourth embodiment described earlier, alternating voltages respectively deviated by $\pi/2$ in phase, with a frequency of 800 HZ and a peak to peak value of voltage Vp-p at 1.5 KV were applied from the phase alternating voltage sources **32*a*, to the respective conductor wires 31 provided within the wall material of the developing material accommodating section 11*b*, while an alternating voltage, with a frequency of 1 KHZ, and a peak to peak value of voltage Vp-p at 250 V is also applied from the alternating voltage source 32C, to the conductor wire 31 provided in the narrow portion 11*d* between the sections 11*b* and 11*a*, thereby to supply the developing material contained in the section 11*b* to the developing sleeve 12 through the gap at the narrow portion 11*d***.

Meanwhile, for the developing material T, toner of the negatively charging characteristic similar to that used in the above test example 3 was used.

Subsequently, for comparison with the results in the above test examples 1 to 4, charge amounts of toner supplied onto the developing sleeve 12 were measured through employment of developing apparatuses DA and DB shown in FIGS. 11 and 12.

COMPARATIVE EXAMPLE 1

Figure 11:
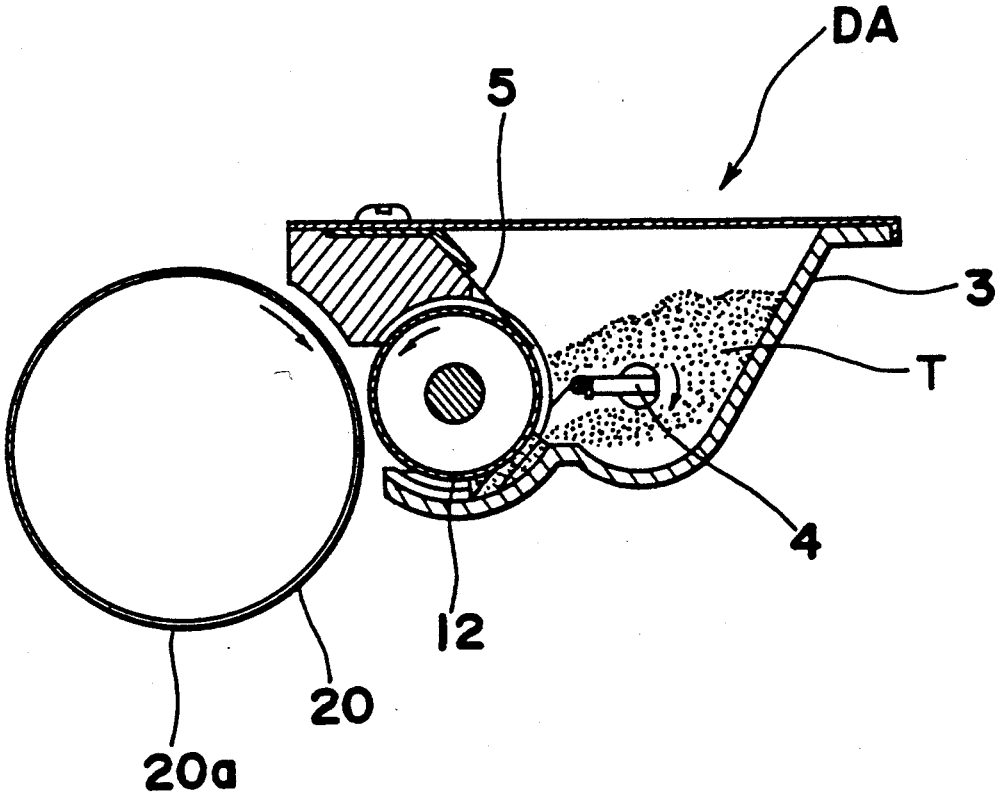
FIG. 11 is a schematic side sectional view showing a state of operation of a developing apparatus DA employed in a comparative example 1.

In the developing apparatus DA used for the comparative example 1 as shown in FIG. 11, it was so arranged that the developing material T accommodated in a developing material tank 3 is stirred by an agitator 4 so as to be fed to the developing sleeve 12, while the developing material T thus fed to the developing sleeve 12 is depressed onto the surface of the developing sleeve 12 by a blade 5 fixed to the apparatus housing in a position above said developing sleeve 12 for pressure contact with the surface of said sleeve 12 so as to restrict the amount of the developing material or the developing sleeve and also to electrically charge the developing material T through contact.

In the comparative example 1 as described above, the toner of the positively charging characteristic similar to that as employed in the test example 1 referred to earlier, was used for the developing material T.

COMPARATIVE EXAMPLE 2

Figure 12:
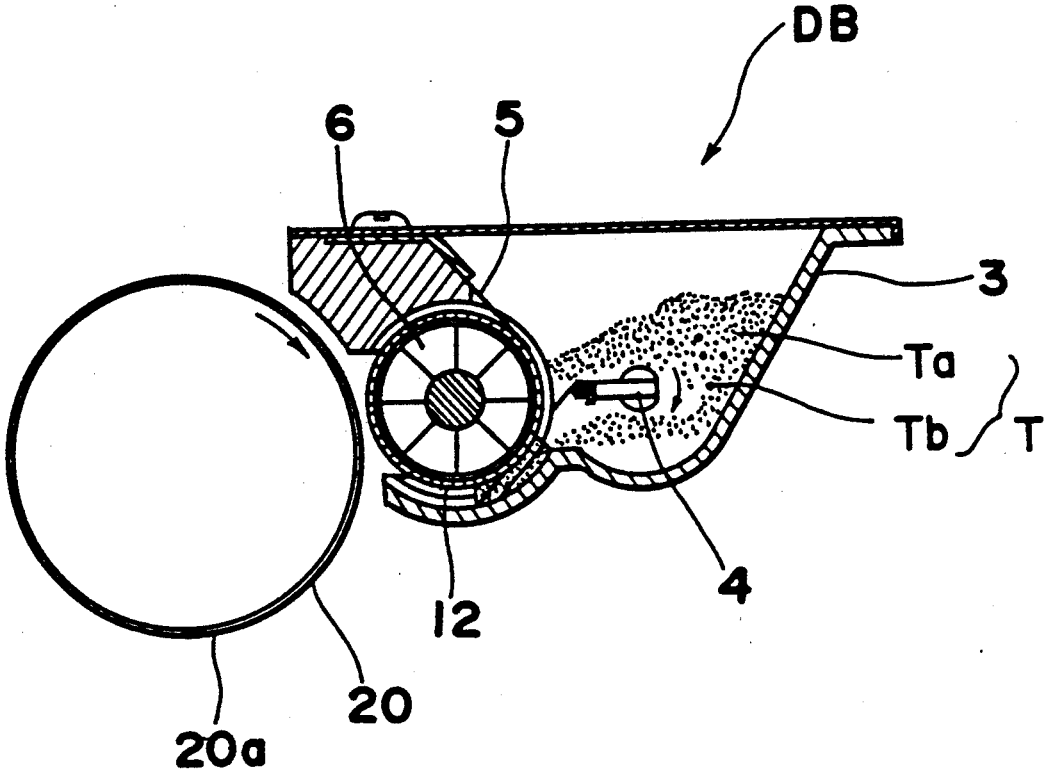
FIG. 12 is a schematic side sectional view showing a state of operation of a developing apparatus DB employed in a comparative example 2.

Although the developing apparatus DB is generally similar to the developing apparatus DA as employed in the above Comparative example 1, a magnet roller 6 was provided within the developing sleeve 12 as shown in FIG. 12.

For the developing material T, a two-component developing material including carrier Tb besides toner Ta was adopted, and in this Comparative example 2, the same two-component developing material T as employed in the test example 2 was used.

Thus, with respect to the test examples 1 to 4 and the comparative examples 1 and 2, charge amounts of toner supplied onto the respective developing sleeves 12 were measured after 20 seconds, 1 minute, 30 minutes, and 2 hours respectively.

The results of the above measurements are shown in Table 1 below.

TABLE 1

| | Toner charge amounts [μC/g] | | | |
|---|---|---|---|---|
| | 20 sec. | 1 min. | 30 min. | 2 hours |
| Test ex. 1 | +14.8 | +16.3 | +17.1 | +17.0 |
| Test ex. 2 | +12.7 | +13.9 | +15.1 | +15.3 |
| Test ex. 3 | −19.6 | −22.9 | −24.0 | −24.9 |
| Test ex. 4 | −16.3 | −17.9 | −19.5 | −19.5 |
| Comp. ex. 1 | +8.1 | +11.9 | +15.1 | +13.8 |
| Comp. ex. 2 | +6.5 | +9.9 | +11.8 | +12.0 |

As is seen from the above results, the arrangements in the respective test examples 1 to 4 employing the developing apparatuses of the embodiments according to the present invention are rapidly increased in the rising speed of charging of toner as compared with those of the comparative example 1 and 2, with the charge amounts thereafter being stabilized in a proper range as compared with those of the comparative examples.

As described so far, in the developing of the present invention, since it is so arranged that, through action of the electric field curtain device of two or more phases constituted by winding conductor wires, the developing material is charged so as to be transported to the developing sleeve, it becomes possible to quickly and uniformly charge the developing material at a proper charge amount for feeding to the developing sleeve.

Consequently, when the developing apparatuses according to the present invention are employed, not only the response characteristics thereof are improved, but the problems in the conventional arrangements such as fogging in the images or scattering of toner, etc. may be eliminated, thus favorable images being obtained.

EMBODIMENT 7

Figure 13:
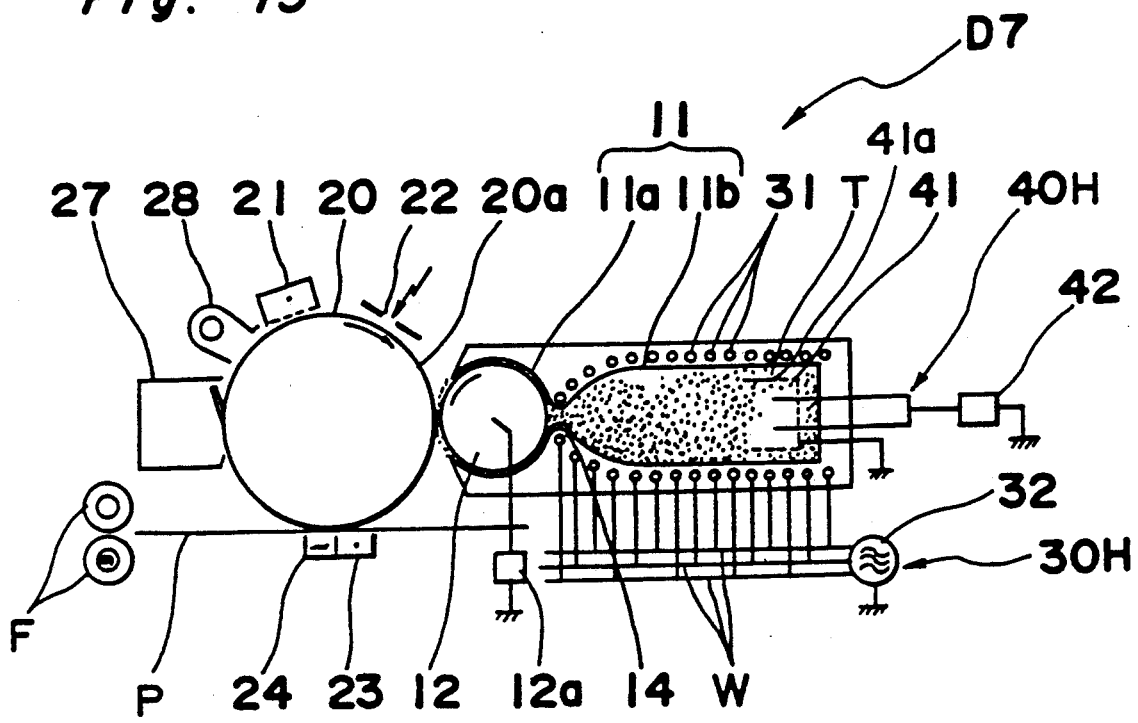
FIG. 13 is a schematic side sectional view of a developing apparatus D7 according to a seventh embodiment of the present invention.

In a developing apparatus D7 according to a seventh embodiment of the present invention as shown in FIG. 13, within the developing material accommodating section **11*b* containing the developing material T, at a rear portion remote from the developing sleeve 12, there is provided a corona charger 41 having its skirt portion 41*a* formed into a mesh shape as a charging device 40H, to which corona charger 41, a charging voltage is impressed from a charging power source 42. The polarity of the charging voltage to be applied from the charging power source 42 to the corona charger 41 is arranged to correspond to the charging polarity of the developing material T contained in the developing material accommodating section 11*b***, and a positive voltage is impressed thereto in the case where the developing material T is to be positively charged, while a negative voltage is impressed in the case where the developing material T is to be negatively charged.

Figure 14:
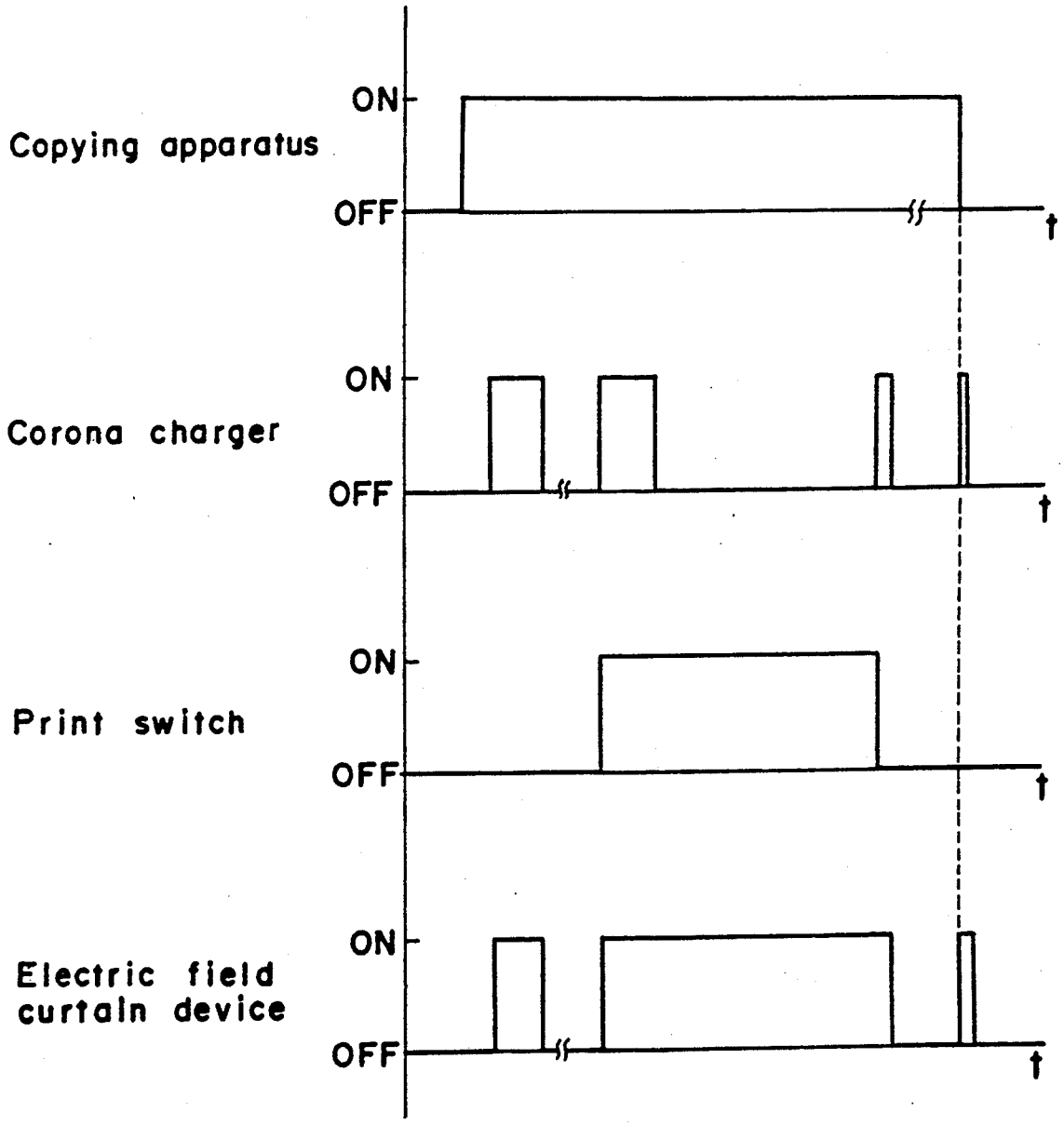
FIG. 14 is a timing-chart for explaining operations of the developing apparatus in FIG. 13.

Subsequently, description will be given with respect to the case where an image is formed on a recording paper P by supplying the developing material T onto the surface **20*a* of the photoreceptor drum 20 from the developing apparatus D7 in a copying machine employing such developing apparatus by referring to FIGS. 13 and 14**.

In the first place, upon turning on of a power source of the copying machine, the charging voltage is applied from the charging power source 42 to the corona charger 41 for a predetermined period of time, so as to charge the developing material T contained in the section **11*b* by the corona charger 41, while alternating voltages respectively deviated in phase from each other are applied to the respective windings 31 from the three phase alternating voltage source 32 for causing the electric field curtain to act, thereby to charge and stir the developing material T preliminarily contained in the developing material accommodating section 11*b***.

Thus, simultaneously with turning on of the print starting switch, the charging voltage is again applied from the charging power source 42 to the corona charger 41 for the predetermined period of time so as to charge the developing material T contained in the section **11*b* by said corona charger 41, while alternating voltages respectively different in phase are applied, through lead wires W, to the respective windings 31 from the three phase alternating voltage source 32 for causing the electric field curtain to act by an electric field curtain device 30H**.

By the above arrangement, with the developing material T charged by the above corona charger 41 acting as a trigger, the developing material T is rapidly and uniformly charged by the above electric field curtain device 30H so as to be successively supplied onto the developing sleeve 12.

It is to be noted here that, even when the copying is completed in the above described manner and the print start switch is turned off, the corona charger 41 and the electric field curtain device 30H should preferably be operated for some more time for uniformly charging and stirring the developing material T within the developing material accommodating section **11*b*, while, when the power source of the copying machine is turned off, the corona charger 41 and the electric field curtain device 30H should be similarly operated for a certain period of time so as to charge and stir the developing material within the section 11*b*** uniformly.

Since other construction and function of the developing apparatus D7 are generally similar to those of the developing apparatus D1 according to the first embodiment shown in FIG. 1, detailed description thereof is abbreviated here for brevity of explanation, with like parts being designated by like reference numerals.

EMBODIMENT 8

Figure 15:
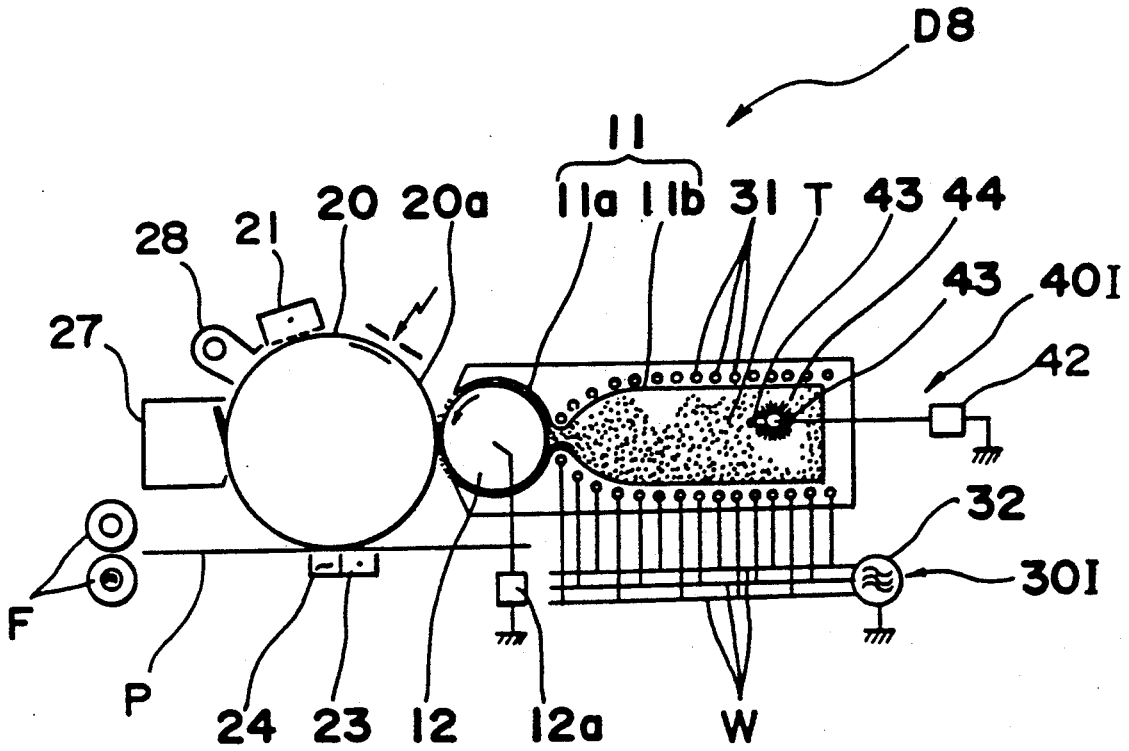
FIG. 15 is a schematic side sectional view of a developing apparatus D8 according to an eighth embodiment of the present invention.

A developing apparatus D8 according to an eighth embodiment of the present invention shown in FIG. 15 is generally similar in construction to the developing apparatus D7 in the seventh embodiment, and includes an electric field curtain device 30I provided in the developing material accommodating section 11b, and a charging device 40I disposed in a position remote from the developing sleeve 12 within the developing material accommodating section 11b for charging the developing material T contained in said developing material accommodating section 11b.

In the developing apparatus D8 of the eighth embodiment, for the charging device 40I, a conductive brush 44 to be rotated through contact with a contact member 43 such as a rubbing rod, wire or the like is provided within the section 11b, while a bias voltage is applied to said conductive brush 44 by a bias voltage source 42 for electric discharge between the conductive brush 44 and the contact member 43 so as to charge the developing material 13 accommodated within the section 11b.

The polarity of the bias voltage to be applied from the bias power source 42 to the conductive brush 44 is developing material T contained in the developing material accommodating section 11b, and a positive voltage is impressed thereto in the case where the developing material is to be positively charged, while a negative voltage is impressed in the case where the developing material T is to be negatively charged.

It is to be noted here that the conductive brush 44 described as employed in the above arrangement may be replaced by a brush made of an insulative material, in which case, a material high in the charging order such as Teflon, glass fiber or the like should preferably be employed.

Since other construction and function of the developing apparatus D8 are generally similar to those of the above developing apparatus D7, detailed description thereof is abbreviated here for brevity of explanation, with like parts being designated by like reference numerals.

EMBODIMENT 9

Figure 16:
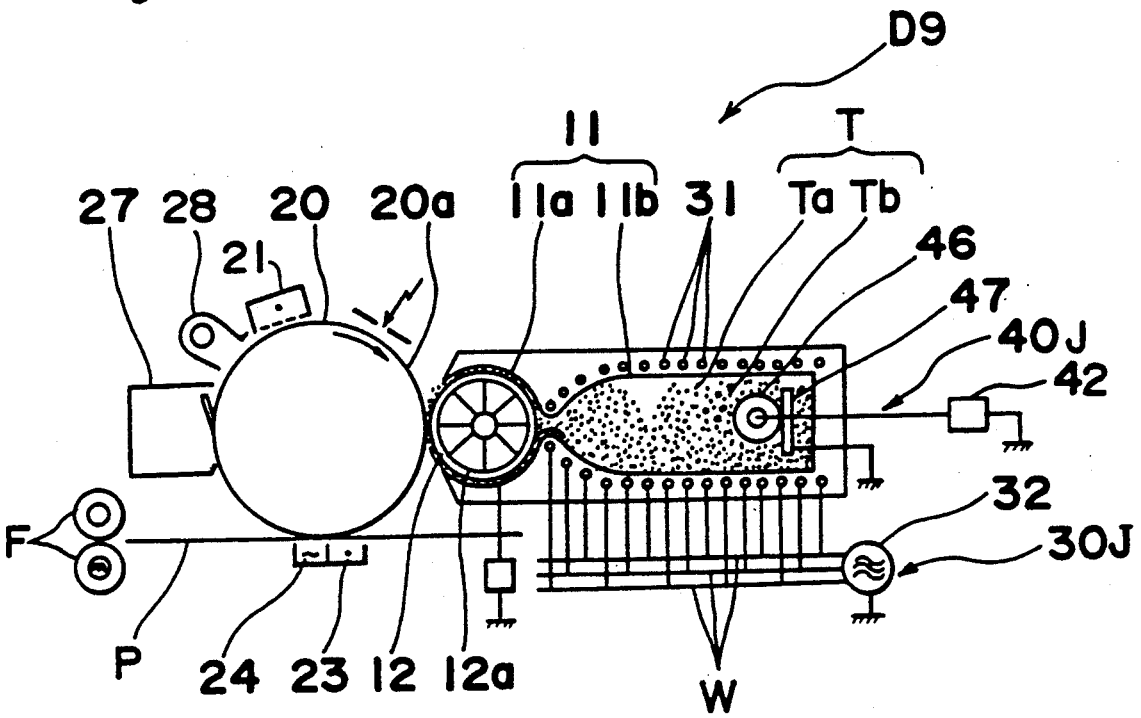
FIG. 16 is a schematic side sectional view of a developing apparatus D9 according to a ninth embodiment of the present invention.

A developing apparatus D9 according to a ninth embodiment of the present invention shown in FIG. 16 also has a construction generally similar to the developing apparatuses D7 and D8 in the seventh and eighth embodiments, and includes an electric field curtain device 30J provided in the developing material accommodating section 11b, and a charging device 40J disposed in a position remote form the developing sleeve 12 within the developing material accommodating section 11b for charging the developing material T contained in said developing material accommodating section 11b.

In the developing apparatus D9 of the ninth embodiment, for the charging device 40J, a conductive rubber roller 46 having very small concave and convex portions or undulation over its peripheral surface is provided to rotate through contact with a metallic plate 47 made of aluminum, SUS, iron, gold, chromium, nickel, copper or the like, with a bias voltage being applied to said roller 46 from a bias power source 42 for electrical discharge between said roller 46 and said metallic plate 47 so as to charge the developing material T contained within the section 11b.

In the above embodiment, a two-component developing material containing carrier Tb besides toner Ta is employed for the developing material T, while a magnet roller 12a is incorporated within the developing sleeve 12.

The polarity of the bias voltage to be applied from the bias power source 42 to the conductive rubber roller 46 is arranged to correspond to the charging polarity of the above toner Ta contained in the developing material accommodating section 11b, and a positive voltage is impressed thereto in the case where the toner Ta is to be positively charged, while a negative voltage is impressed in the case where the toner Ta is to be negatively charged.

Since other construction and function of the developing apparatus D9 are generally similar to those of the developing apparatuses D7 and D8 described earlier, detailed description thereof is abbreviated here for brevity of explanation, with like parts being designated by like reference numerals.

EMBODIMENT 10

Figure 17:
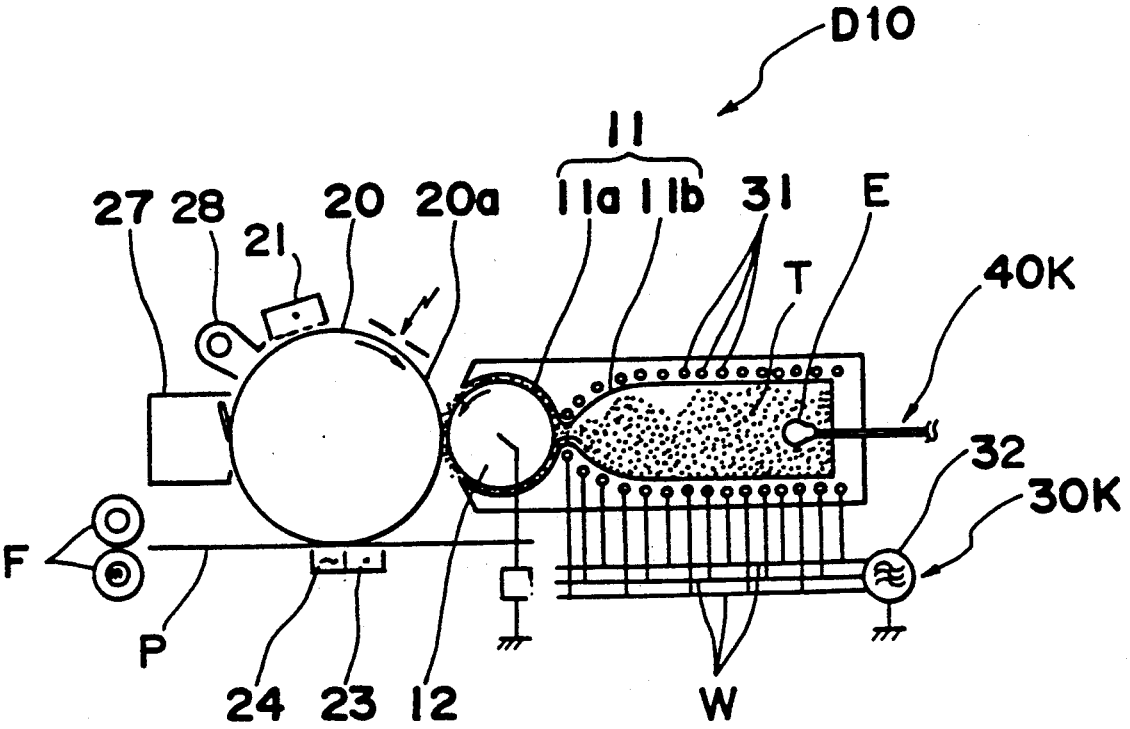
FIG. 17 is a schematic side sectional view of a developing apparatus D10 according to a tenth embodiment of the present invention.

A developing apparatus D10 according to a tenth embodiment of the present invention shown in FIG. 17 is generally similar in construction to the developing apparatuses D7 to D9 in the foregoing embodiments, and includes an electric field curtain device 30K provided in the developing material accommodating section 11b, and a charging device 40K disposed in a position remote from the developing sleeve 12 within the developing material accommodating section 11b for charging the developing material T contained in said developing material accommodating section 11b.

In the developing apparatus D10 of the tenth embodiment, for the charging device 40K, an electron beam tube E is provided within the section 11b for imparting electrons to the developing material T contained in said section 11b, with a developing material having a characteristic to be negatively charged being employed for the developing material T.

Since other construction and function of the developing apparatus D10 are generally similar to those of the developing apparatuses D7 to D9 as described earlier, detailed description thereof is abbreviated here for brevity of explanation, with like parts being designated by like reference numerals.

Subsequently, as test examples 5 to 7, through employment of the developing apparatuses D7 to D9 for the foregoing embodiments, charge amounts of the developing material T fed onto the respective developing sleeve 12 were measured, with results as follows.

TEST EXAMPLE 5

Through employment of the developing apparatus D7 in FIG. 13 for the seventh embodiment described earlier, a d.c. voltage at 5 KV was applied from the charging power source 42 to the corona charger 41 provided in the developing material accommodating section 11b for electrical discharge, while alternating voltages respectively deviated in phase, with a frequency of 300 HZ and a peak to peak value of voltage Vp-p at 900 V were applied from the three phase alternating voltage source 32, to the respective conductor wires 31 provided within the wall material of the developing material accommodating section 11b so as to cause the electric field curtain to act.

Here, for the developing material T, 100 weight parts of styrene-acrylic copolymer (softening point 132° C., glass transition point 60° C.), 5 weight parts of carbon black (MA#8, referred to earlier) and 3 weight parts of nigrosine dye (Bontron N-01, referred to earlier) were sufficiently mixed by a ball mill so as to be kneaded on three rolls heated up to 140° C., and after being left for cooling, the mixture was roughly ground through employment of a feather mill so as to be further pulverized by a jet mill, and classified by wind to obtain positively charging toner with an average particle diameter of 11.5 μm for use in the developing material.

TEST EXAMPLE 6

For this test example 6, the developing apparatus D8 for the eighth embodiment shown in FIG. 15 was employed.

The conductive brush 44 rotatably provided within the developing material accommodating section 11*b* is rotated at revolutions of 80 r.p.m., with a d.c. voltage at 500 V being applied to said conductive brush 44 from the bias power source 42 so as to effect electrical discharge between the conductive brush 44 and the contact member 43, while in the similar manner as in the Test example 5, alternating voltages respectively deviated in phase, with a frequency of 800 HZ and a peak to peak value of voltage Vp-p at 700 V were applied from the three phase alternating voltage source 32, to the respective conductor wires 31 provided within the wall material of the developing material accommodating section 11*b* so as to cause the electric field curtain to act.

Here, for the developing material T, 100 weight parts of polyester resin (softening point 130° C., glass transition point 60° C., AV 25, OHV 38), 5 weight parts of carbon black (MA#8, referred to earlier) and 3 weight parts of dye (Spiron black TRH, referred to earlier) were sufficiently mixed by a ball mill so as to be kneaded on three rolls heated up to 140° C., and after being left for cooling, the mixture was roughly ground through employment of a feather mill so as to be further pulverized by a jet mill, and classified by wind to obtain negatively charging toner with an average particle diameter of 12 μm for use in the developing material.

TEST EXAMPLE 7

For the Test example 7, the developing apparatus D9 for the ninth embodiment as shown in FIG. 16 was employed.

For the test, a d.c. voltage at 500 V was applied from the bias voltage source 42 to the conductive rubber roller 46 provided within the developing material accommodating section 11*b* for rotation through contact with the metallic plate 47 to effect electrical discharge between said conductive rubber roller 46 and said metallic plate 47, while in the similar manner as in the above test examples, alternating voltages respectively deviated in phase, with a frequency of 500 Hz and a peak to peak value of voltage Vp-p at 1.1 KV were applied from the three phase alternating voltage source 32, to the respective conductor wires 31 through the lead wires W so as to cause the electric field curtain to act.

Here, for the developing material T, a two-component developing material including toner Ta and carrier Tb was employed.

For the toner Ta, toner of a positively charging characteristic similar to that used in the above test example 5 was employed, while as carrier Tb, there was used magnetic carrier prepared by sufficiently mixing and grinding, with a Henschel mixer, 100 weight parts of polyester resin (softening point 123° C., glass transition point 65° C., AV 23, OHV 40), 500 weight parts of inorganic magnetic powder (EPT-1000, referred to earlier) and 2 weight parts of carbon black (MA#8, referred to earlier) and then, melting and kneading the mixture by an extruding kneader set at temperatures of 180° C. at a cylinder portion and at 170° C. at a cylinder head portion for subsequent cooling and pulverization by a jet mill, and thereafter classifying the fine particles through employment of a classifier to obtain the magnetic carrier with an average particle diameter of 55 μm.

Subsequently, for comparison with the results in the above test examples 5 to 7, charge amounts of toner supplied onto the developing sleeve 12 were measured through employment of developing apparatuses DC and DD shown in FIGS. 18 and 19 as comparative examples 3 and 4.

COMPARATIVE EXAMPLE 3

Figure 18:
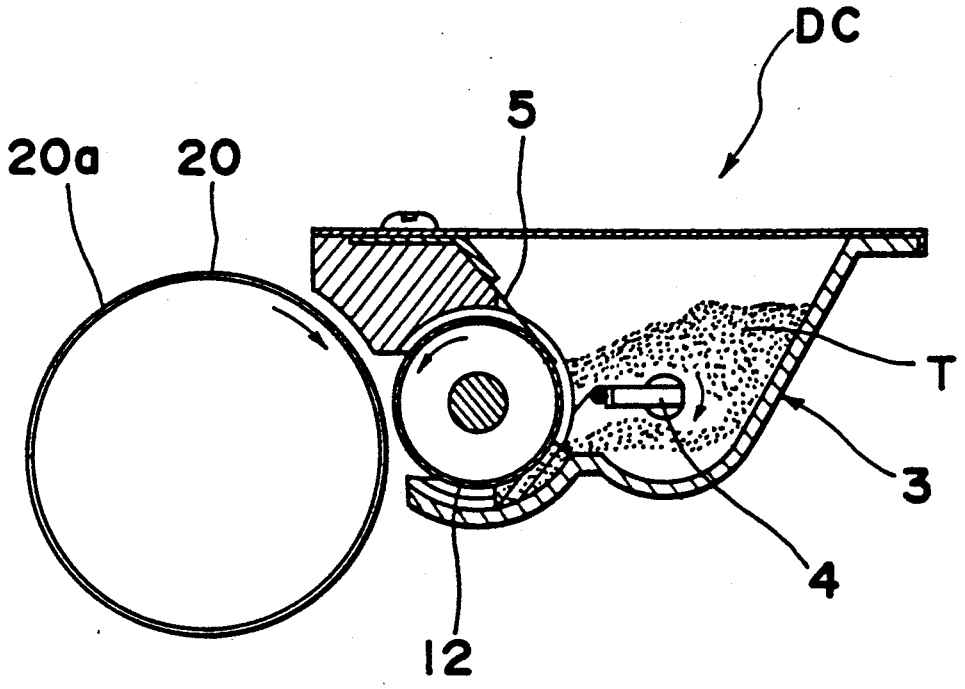
FIG. 18 is a schematic side sectional view showing a state of operation of a developing apparatus DC employed in a comparative example 3.

In the developing apparatus DC used for the comparative example 3 as shown in FIG. 18, it was so arranged that the developing material T accommodated in a developing material tank 3 is stirred by an agitator 4 so as to be fed to the developing sleeve 12, while the developing material T thus fed to the developing sleeve 12 was depressed onto the surface of the developing sleeve 12 by a blade 5 for electrical charging.

In the comparative example 3 as described above, toner of the positively charging characteristic similar to that as employed in the test example 5 referred to earlier was used for the developing material T.

COMPARATIVE EXAMPLE 4

Figure 19:
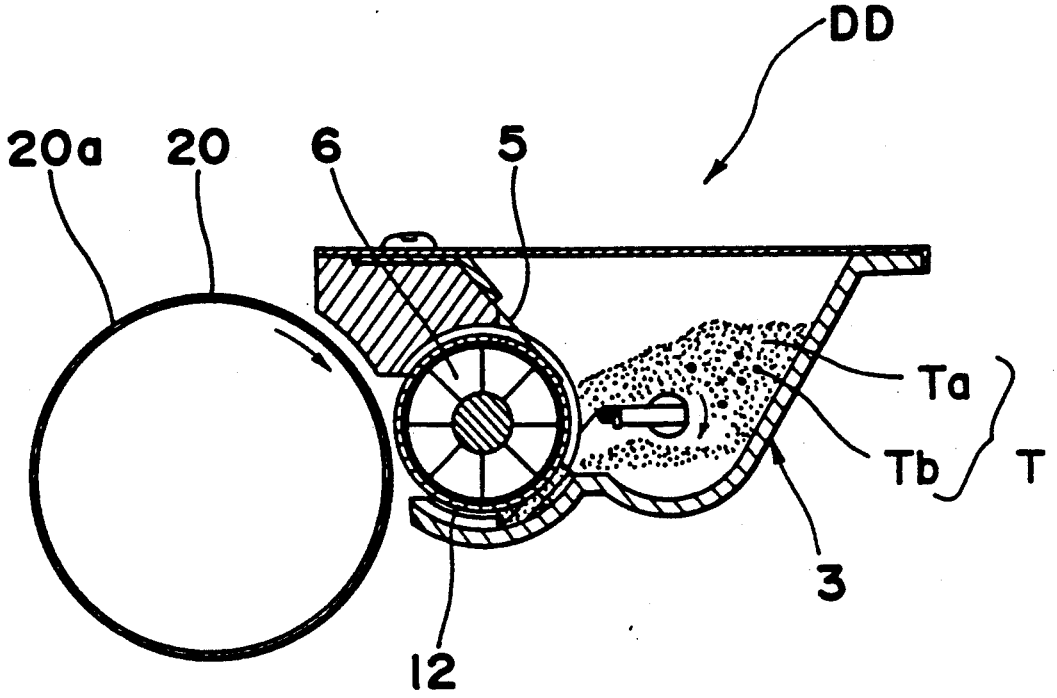
FIG. 19 is a schematic side sectional view showing a state of operation of a developing apparatus DD employed in a comparative example 4.

Although the developing apparatus DD employed for the comparative example 4 is generally similar to the developing apparatus DC as employed in the Comparative example 3, the magnet roller 6 is provided within the developing sleeve 12 as shown in FIG. 19, while the two-component developing material T containing toner Ta and carrier Tb was employed.

For the above developing material T, the developing material similar to that as used in the Test example 7 was adopted.

Thus, with respect to the Test examples 5 to 7 and the comparative examples 3 and 4, charge amounts of toner supplied onto the respective developing sleeves were measured after 16 seconds, 1 minute, 30 minutes, and 2 hours respectively, and simultaneously, evaluation was effected with respect to the images formed by these developing apparatuses.

The results of the above measurements for the toner charge amounts are shown in Table 2 below.

TABLE 2

| | Toner charge amount [μC/g] | | | |
|---|---|---|---|---|
| | 16 sec. | 1 min. | 30 min. | 2 hours |
| Test ex. 5 | +12.3 | +18.3 | +19.9 | +20.7 |
| Test ex. 6 | −13.1 | −18.4 | −22.0 | −22.6 |
| Test ex. 7 | +12.2 | +17.6 | +19.7 | +19.8 |
| Comp. ex. 3 | +5.3 | +8.6 | +14.9 | +11.7 |
| Comp. ex. 4 | +3.8 | +7.4 | +10.3 | +8.5 |

With respect to the images thus formed, those of the respective test examples 5 to 7 which employ the developing apparatuses D7 to D9 of the embodiments were superior, without scattering of toner or fogging, etc., while the image in the comparative example 3 showed coagulation of toner, together with fogging due to scattering of toner, while fogging in the ground was noticed in the image for the comparative example 4.

As is seen from the above results, the arrangements in the respective test examples 5 to 7 employing the developing apparatuses of the embodiments according to the present invention are rapidly increased in the rising speed of charging of toner as compared with those of the comparative example 3 and 4, with the charge amounts thereafter being stabilized in a proper range as compared with those of the comparative examples, thereby providing favorable images.

As is seen from the foregoing description, in the developing apparatus of the present invention, since the electric field curtain device of two or more phases is provided, together with the charging device disposed within said curtain device, the developing material charged by said charging device acts as a trigger, and by the action of the electric field curtain by the electric field curtain device, the developing material is to be charged quickly and uniformly up to a proper charge amount.

As a result, when the developing apparatus according to the present invention is used, not only the response characteristic of the developing apparatus is improved, but the developing material is properly charged, without disadvantages as in the conventional developing apparatuses such as fogging in the images, scattering of toner, etc., and thus, clear and definite images maybe obtained.

EMBODIMENT 11

Figure 20:
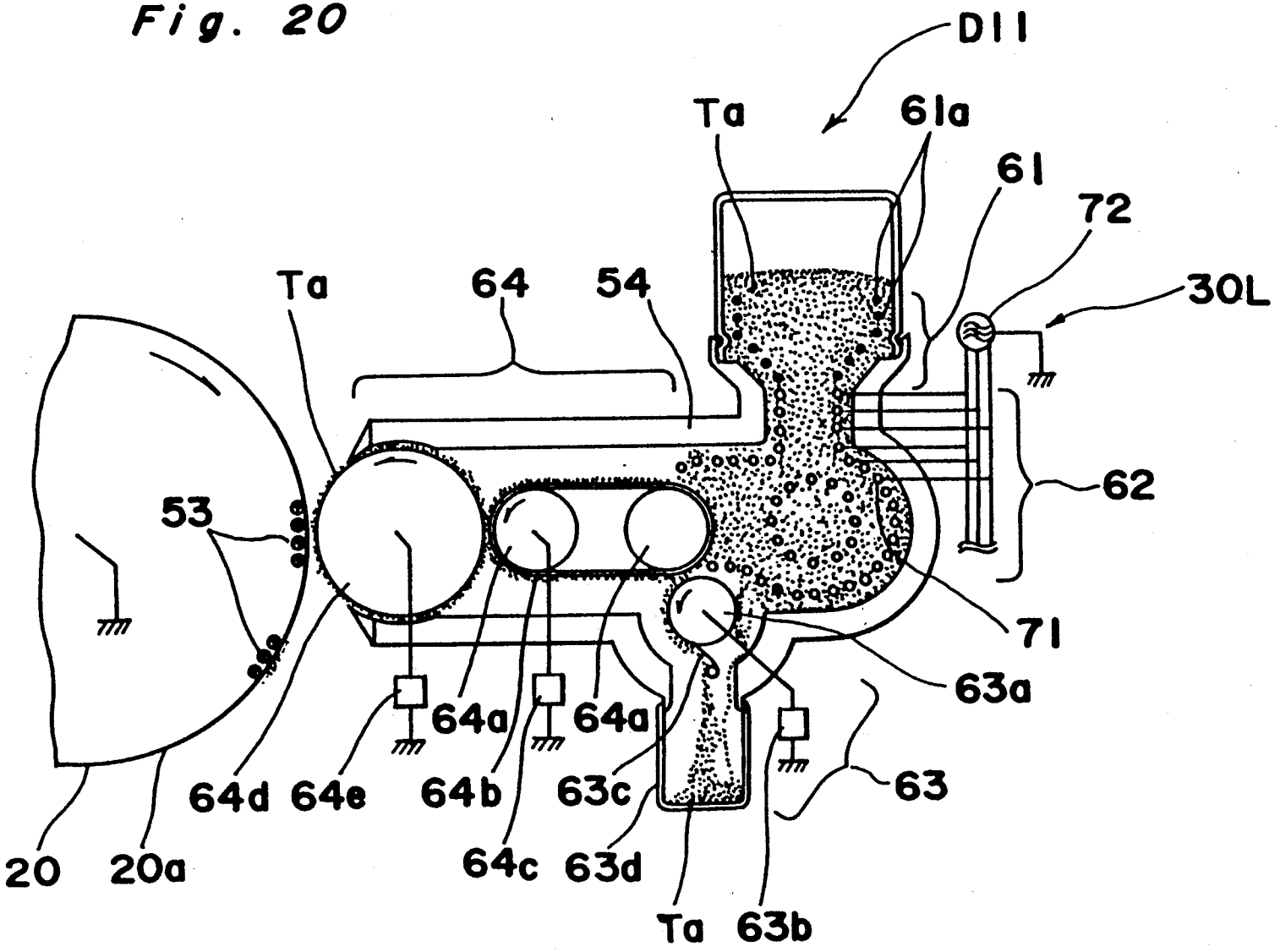
FIG. 20 is a schematic side sectional view of a developing apparatus D11 according to an eleventh embodiment of the present invention.

In this embodiment, there is provided as shown in FIG. 20, a developing apparatus D11 which includes, in a casing 54 thereof, a contact charging section 61 for causing an uncharged developing material T to be electrically charged through contact, a preliminary charging section 62 for uniformly subjecting the developing material T led from the contact charging section 61 to preliminary electrical charging, a charge amount selecting section 63 for selecting the developing material electrically charged in a proper amount by eliminating the developing material improperly charged in the developing material preliminarily charged in said preliminary charging section 62, and a charged particulate material transport section 64 for transporting the developing material T charged at the proper amount and selected by the charge amount selecting section 63, toward the developing side, and further, an electric field curtain device 301 provided only at the preliminary charging section 62, with only toner Ta being employed for the developing material T. In the above developing apparatus D11, charging members 61*a* are provided at the contact charging section 61 for subjecting the uncharged toner Ta to contact charging.

Here, for the charging members 61*a*, members constituted by a negatively charging material, e.g. resin of a fluorine group, etc. are generally employed when the toner Ta is to be positively charged, while members made of a positively charging material, such as PMM or the like are used when the toner Ta is to be negatively charged.

Thus, at the contact charging section 61, the toner Ta is slightly charged by the contact and friction, and is then supplied to the preliminary charging section 62 provided with the electric field curtain device 30L as described above.

Figure 21:
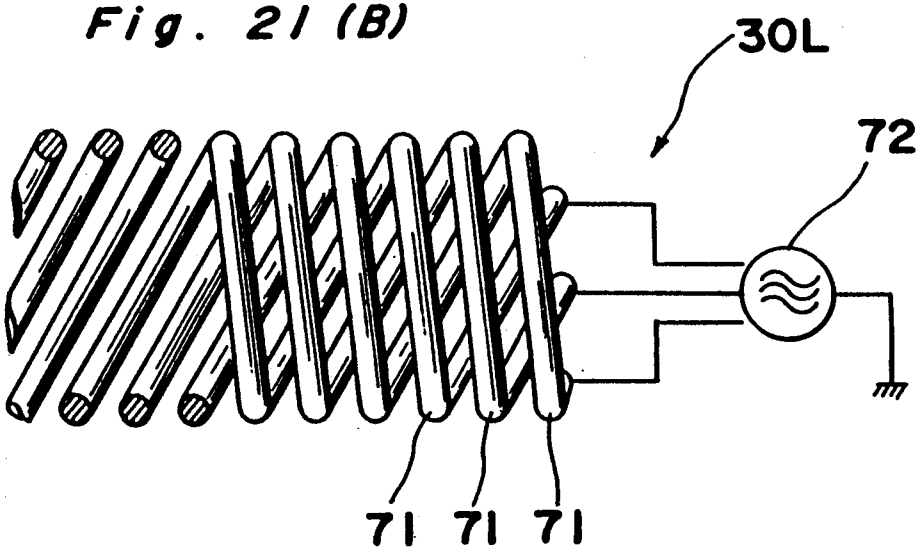
FIG. 21(A) is a side sectional view on an enlarged scale, of a coil for an electric field curtain device employed in the embodiment of FIG. 20.
FIG. 21(B) is a side elevational view of an electric field curtain device employed in the arrangement of FIG. 20.
Figure 21:
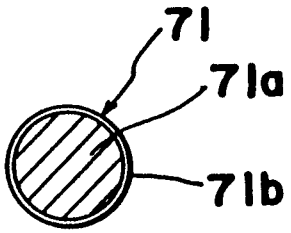

For the electric field curtain device 30L to be provided at the preliminary charging section 62, as shown in FIGS. 21(A) and 21(B), conductive wires 71*a* made of copper or the like and covered with an insulative material 71*b* such as enamel or the like on the surface are wound into coils 71 of three phases, which are connected to a three phase alternating voltage source 72 in the Y-connection.

Thus, alternating voltages deviated in phase by $\frac{2}{3}\pi$ are respectively applied to the conductive wires 71 from said three phase alternating voltage source 72, thereby to form a travelling wave alternating non-uniform electric field row.

Figure 22:
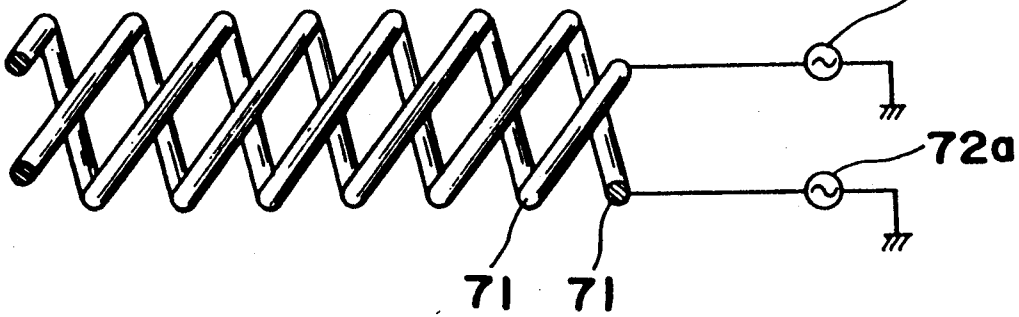
FIG. 22 is a view similar to FIG. 21(B), which particularly shows a modification thereof.

It is to be noted here that the electric field curtain device to be employed in this embodiment is no limited to the curtain device 30L as described above, but may be, for example, so modified as in a curtain device 30L' shown in FIG. 22 that, by forming two phase coils 71 by the conductive wires 71*a*, alternating voltages deviated in phase by $\pi/2$ are applied to the respective coils 71 from alternating voltage sources 72*a*, thereby to form a standing wave alternating non-uniform electric field row.

In the preliminary charging section 62 as referred to above, the non-uniform alternating electric field is formed by the electric field curtain device 30L as described so far, and the slightly charged toner Ta fed from the contact charging section 61 is preliminarily charged uniformly by the action of the electric field curtain so as to be fed to the subsequent charge amount selecting section 63.

Thus, in the charge amount selecting section 63, a bias voltage is applied to a developing material collecting roller 63*a* from a bias voltage source 63*b*, and in the toner Ta preliminarily charged at said preliminary charging section 62, the toner Ta insufficiently charged is attracted by the collecting roller 63*a*, and is then removed from said roller 63*a* by a cleaning member 63*c* so as to be collected into a collecting box 63*d*. It is to be noted that the poorly charged toner Ta thus collected may be arranged to be fed to the contact charging section 61 again.

On the other hand, at the above charge amount selecting section 63, the toner Ta not attracted by the collecting roller 63*a*, and not charged at a proper amount is to be transported to the next charged particulate material transport section 64.

At the above charged particulate material transport section 64, a pair of transport rollers 64*a* are provided through a predetermined interval therebetween, while a transport belt 64*b* electrically connected to such rollers is passed around said transport rollers 64*a*, whereby, through application of a bias voltage to one of the transport rollers 64*a* from a bias voltage source 64*c* so as to attract the properly charged toner Ta onto the belt 64*b*, and by rotating said rollers 64*a*, the toner Ta charged at the proper amount is transported to the developing sleeve 64*d*.

Thus, by applying a bias voltage to the developing sleeve 64*d* from a bias voltage source 64*e*, the toner Ta transported by the above transport belt 64*b* is attracted onto the developing sleeve 64*d* so as to be further supplied onto an electrostatic latent image formed portion 53 on the surface 20*a* of the photoreceptor drum 20.

EMBODIMENT 12

Figure 23:
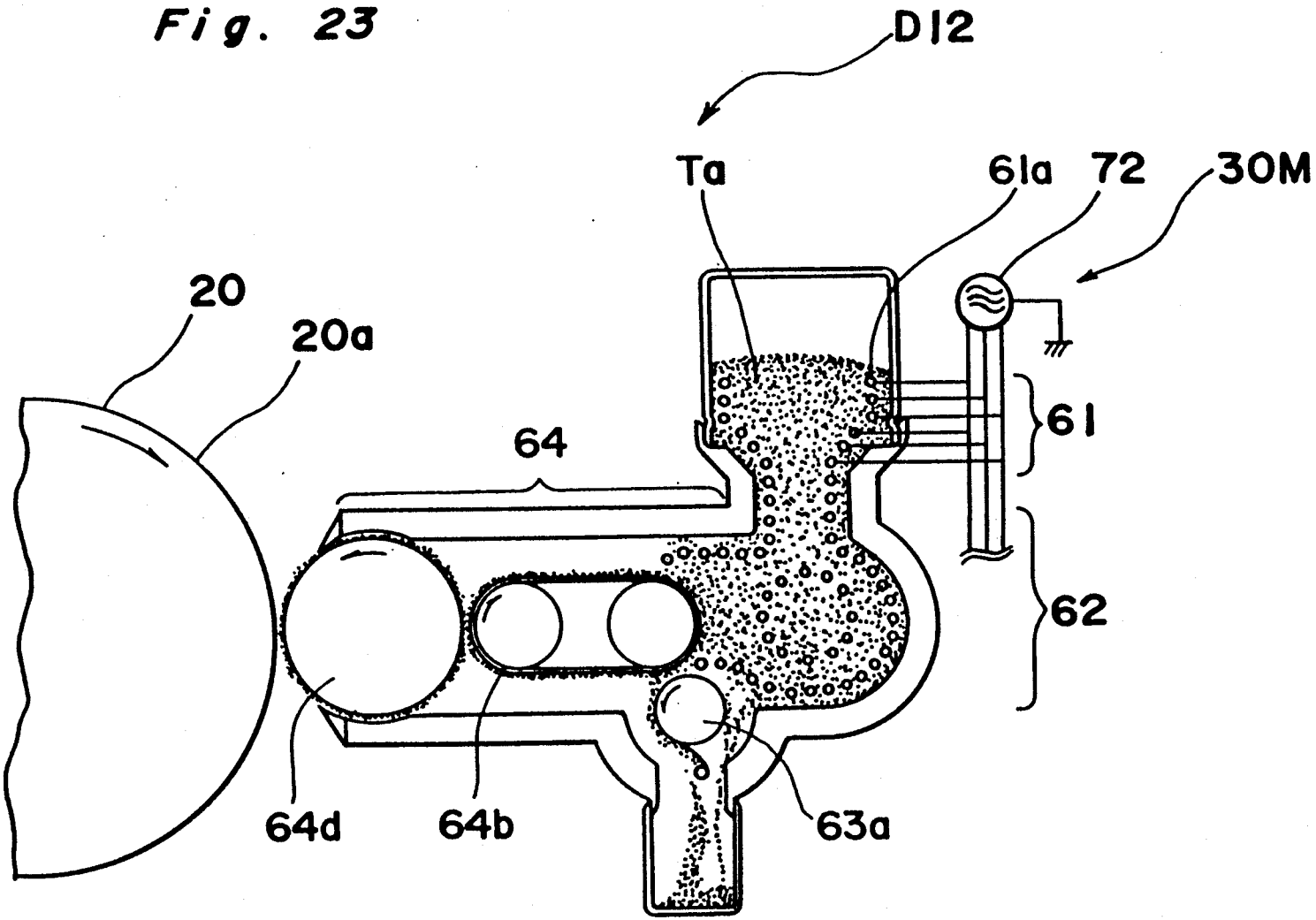
FIG. 23 is a schematic side sectional view of a developing apparatus D12 according to a twelfth embodiment of the present invention.

As shown in FIG. 23, a developing apparatus D12 for a twelfth embodiment of the present invention has a construction generally similar to the above developing apparatus D11, and is provided with an electric field curtain device at its preliminary charging section 62, although not particularly shown.

The developing apparatus D12 in FIG. 23 is characterized in that another electric field curtain device 30M similar to that provided in the preliminary charging section 62 is further provided at the portion of the charging members 61*a* for the contact charging section 61 to subject the toner Ta to the contact charging, thereby to charge the uncharged toner Ta more efficiently.

Since other construction and function of the developing apparatus D12 are generally similar to those of thereof is abbreviated here for brevity of explantion, with like parts being designated by like reference numerals.

EMBODIMENT 13

Figure 24:
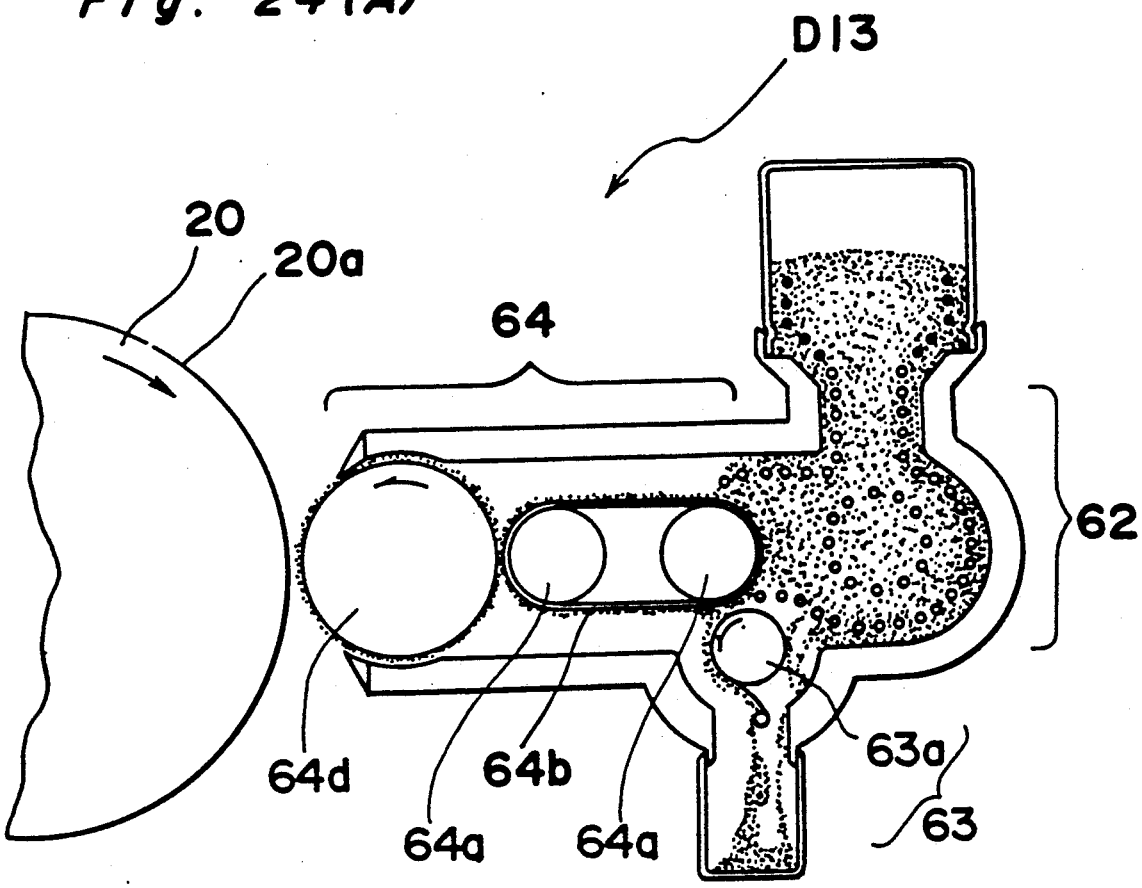
FIG. 24(A) is a schematic side sectional view of a developing apparatus D13 according to a thirteenth embodiment of the present invention.
FIG. 24(B) is a fragmentary diagram showing a state in which an electric field curtain device is provided on a transport belt in the arrangement of FIG. 24(A)
Figure 24:
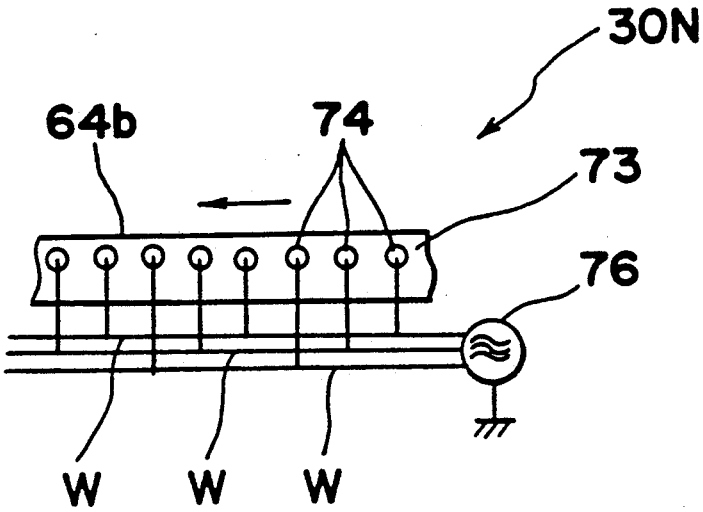

A developing apparatus D13 according to a thirteenth embodiment of the present invention as shown in FIG. 24(A) is generally similar in construction, to the developing apparatus D11 of the eleventh embodiment described earlier, and although not particularly shown, is provided with an electric field curtain device at the preliminary charging section 62 thereof in the similar manner as in the developing apparatus D11.

In the developing apparatus D13 of this thirteenth embodiment, an electric field curtain device 30N is further provided also at the transport belt 64*b* provided for the charged particulate material transport section 64.

As shown in FIG. 24(B), in the electric field curtain device 30N provided for the transport belt 64*b*, a plurality of electrodes 74 made of copper are provided within a dielectric material layer 73 for the belt 64*b* made, for example, of a polyimide resin, and every two electrodes 74 are sequentially connected to three lead wires W to divide the electrodes 74 into three groups, while the respective lead wires are connected to a three phase alternating voltage source 76 of the Y-connection, thereby to apply alternating voltages deviated in phase by $\frac{2}{3}\pi$ to the respective electrode groups through the lead wires W for the formation of the travelling wave alternating non-uniform electric field row.

Thus, by the electric field curtain device 30N provided on the transport belt 64*b* as described above, the toner Ta led from the charge amount selecting section 63 and properly charged is successively transferred onto the developing sleeve 64*d*. It is to be noted here that, in the above case, it need not necessarily be arranged to displace the transport belt 64*b* by rotating the transport rollers 64*a*, but the arrangement may, for example, be so modified that the toner is guided onto the developing sleeve 64*d* through combination of the displacement by the transport belt 64*b* and the action of the electric field curtain by the curtain device 30N.

EMBODIMENT 14

Figure 25:
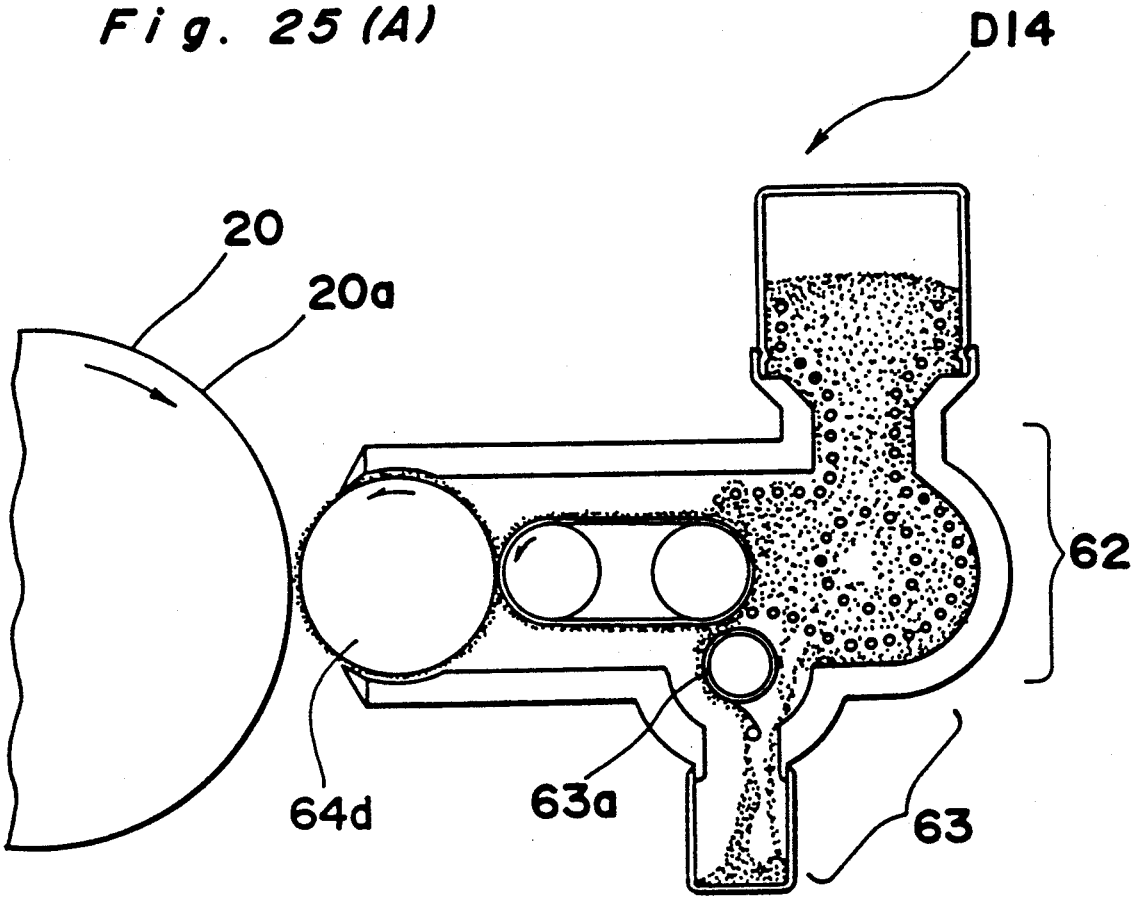
FIG. 25(A) is a schematic side sectional view of a developing apparatus D14 according to a fourteenth embodiment of the present invention.
FIG. 25(B) is a fragmentary diagram showing a state in which an electric field curtain device is provided on a developing material collecting roller in the arrangement of FIG. 25(A)
Figure 25:
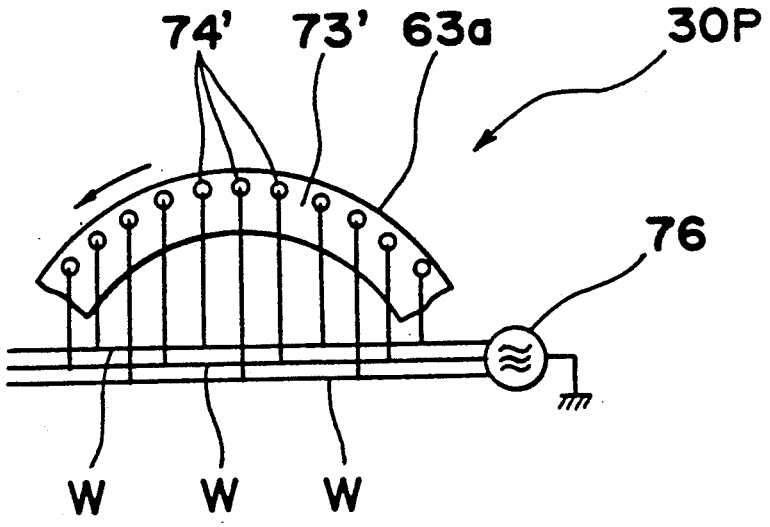

A developing apparatus D14 according to a fourteenth embodiment of the present invention shown in FIG. 25(A) is also generally similar in construction, to the developing apparatus D11 of the eleventh embodiment described earlier, and although not particularly shown, is provided with an electric field curtain device at the preliminary charging section 62 thereof in the similar manner as in the developing apparatus D11.

In the developing apparatus D14 as described so far, as shown in FIG. 25(B), it is so arranged that another electric field curtain device 30P similar to that provided on the transport belt 64*b* in the above developing apparatus D13 is provided on the developing material collecting roller 63*a* at the charge amount selecting section 63.

As shown in FIG. 25(B), in the electric field curtain device 30P provided on the developing material collecting roller 63*a*, a plurality of electrodes 74' made of copper are provided within a dielectric material layer 73', for the roller 63*a* made, for example, of a polyimide resin, and every two electrodes 74, are similarly connected to three lead wires W to divide the electrodes 74' into three groups, while the respective lead wires W are connected to a three phase alternating voltage source 76 of the Y-connection, thereby to apply alternating voltages deviated in phase by $\frac{2}{3}\pi$ to the respective electrode groups through the lead wires for the formation of the travelling wave alternating non-uniform electric field row as in the above developing apparatus D13.

EMBODIMENT 15

Figure 26:
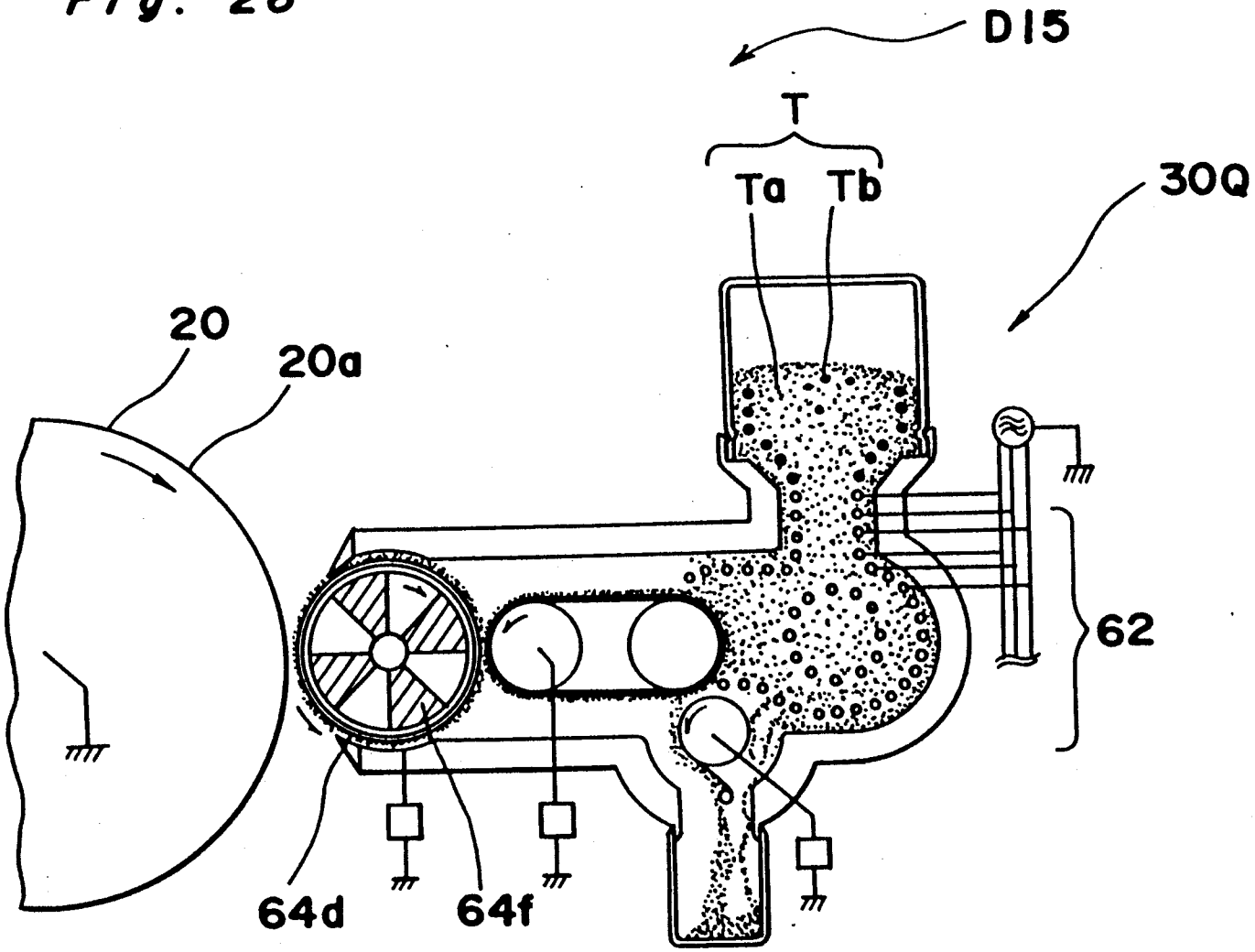
FIG. 26 is a schematic side sectional view of a developing apparatus D15 according to the fifteenth embodiment of the present invention.

As shown in FIG. 26, in this embodiment, there is provided a developing apparatus D15 which uses a two-component developing material containing toner Ta and carrier Tb, and includes a magnet roller 64*f* having eight poles and incorporated within the developing sleeve 64*d* for supplying the toner onto the surface 20*a* of the photoreceptor drum 20, with said magnet roller 64*f* being rotated in a direction opposite to that of the developing sleeve 64*d*.

Besides the above point, the developing apparatus D15 is generally similar in construction, to the developing apparatus D11 described earlier, and is provided with the electric field curtain device 30Q only at the preliminarily charging section 62.

Since other construction and function of the developing apparatus D15 are generally similar to those of the developing apparatus D11 in FIG. 20, detailed description thereof is abbreviated here for brevity of explanation, with like parts being designated by like reference numerals.

EMBODIMENT 16

Figure 27A:
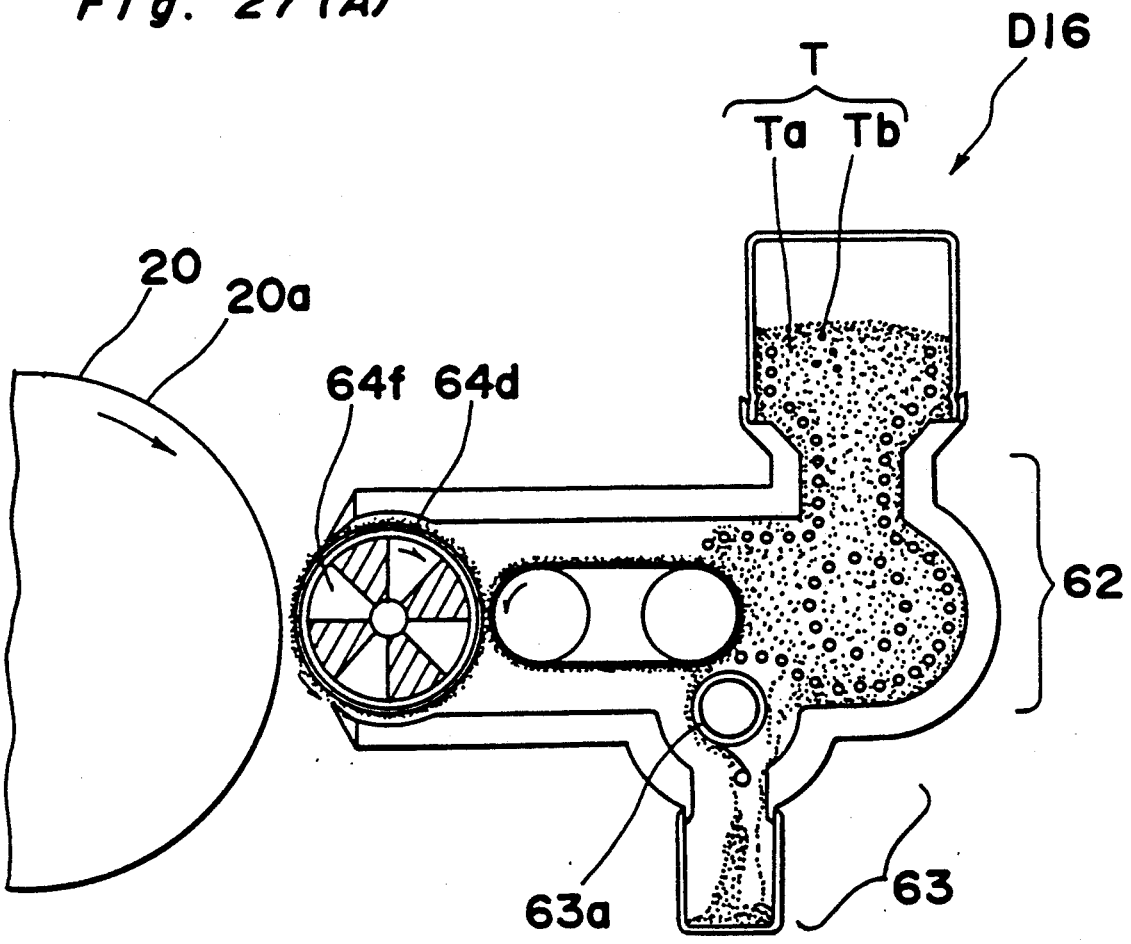
FIG. 27(A) is a schematic side sectional view of a developing apparatus D16 according to a sixteenth embodiment of the present invention.

A developing apparatus D16 according to a sixteenth embodiment of the present invention shown in FIG. 27(A) also employs a two-component developing material T containing toner Ta and carrier Tb, and includes magnet roller 64*f* having eight poles and incorporated within the developing sleeve 64*d* for supplying the toner onto the surface 20*a* of the photoreceptor drum 20, with said magnet roller 64*f* being rotated in a direction opposite to that of the developing sleeve 64*d*.

Figure 27B:
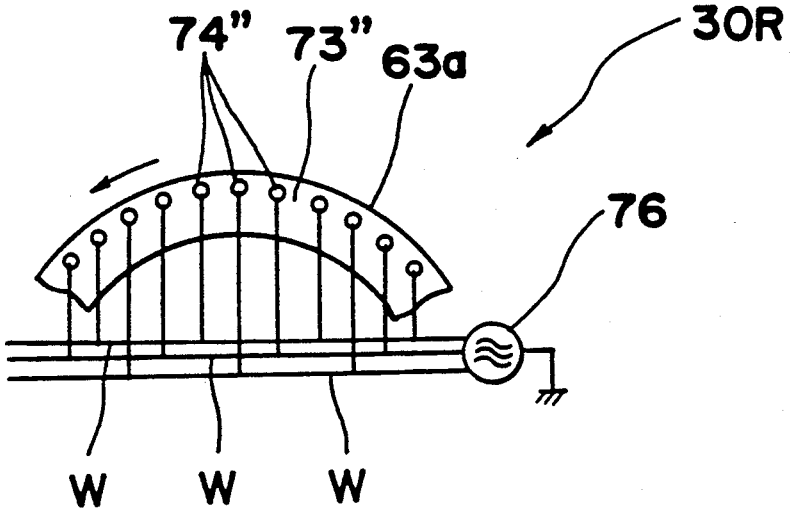
FIG. 27(B) is a fragmentary diagram showing a state in which an electric field curtain device is provided on a developing material collecting roller in the arrangement of FIG. 27(A)

With respect to the points other than the above, the construction is generally similar to that of the developing apparatus D14 in the fourteenth embodiment, and besides the electric field curtain device (not shown) provided at the preliminary charging section 62, a curtain device 30R similar to that in the fourteenth embodiment is provided on the developing material collecting roller 63*a* at the charge amount selecting section 63 as shown in FIG. 27(B).

Since the construction of the curtain device 30R is similar to that curtain device 30P described earlier with reference to FIG. 25(B), detailed description thereof is abbreviated here for brevity of explanation, with like parts being represented by like reference numerals having two primes.

Subsequently, as test examples 8 to 13, three-phase alternating voltages each having the peak to peak value of the voltage Vp-p at 1 KV and a frequency of 900 Hz were applied to the electric field curtain devices provided on the respective developing apparatuses D11 to D16 for the eleventh to sixteenth embodiments, so as to measure the charge amounts of toner supplied onto the respective developing sleeves.

TEST EXAMPLE 8

For Test example 8, the developing apparatus D11 for the eleventh embodiment as shown in FIG. 20 was employed as the developing apparatus.

For the developing material T, 100 weight parts of styrene-acrylic copolymer (softening point 132° C., glass transition point 60° C.), 5 weight parts of carbon black (MA#8, referred to earlier) and 3 weight parts of nigrosine dye (Bontron N-01, referred to earlier) were sufficiently mixed by a ball mill so as to be kneaded on three rolls heated up to 140° C., and after being left for cooling, the mixture was roughly ground through employment of a feather-mill so as to be further pulverized by a jet mill, and classified by wind to obtain positively charging toner with an average particle diameter of 13 μm for use in the developing material.

TEST EXAMPLE 9

In this test example, the developing apparatus D12 for the twelfth embodiment shown in FIG. 23 was employed, and toner having a positive charging characteristic similar to that used in the above Test example 8 was adopted.

TEST EXAMPLE 10

In this test example, the developing apparatus D13 for the thirteeth embodiment shown in FIGS. 24(A) and 24(B) was employed, and toner having a positive charging characteristic similar to that used in the above Test examples 8 and 9 was adopted.

TEST EXAMPLE 11

For this test example 11, the developing apparatus D14 for the fourteenth embodiment shown in FIGS. 25(A) and 25(B) was employed.

For the toner, 100 weight parts of polyester resin (softening point 130° C., glass transition point 60° C., AV 25, OHV 38), 5 weight parts of carbon black (MA#8, referred to earlier) and 3 weight parts of dye (Spiron black TRH, referred to earlier) were sufficiently mixed by a ball mill so as to be kneaded on three rolls heated up to 140° C., and after being left for cooling, the mixture was roughly ground through employment of a feather mill so as to be further pulverized by a jet mill, and classified by wind to obtain negatively charging toner with an average particle diameter of 13 μm for use in the developing material.

TEST EXAMPLE 12

For Test example 12, the developing apparatus D15 for the fifteenth embodiment as shown in FIG. 26 was employed.

For the toner, toner of a positive charging characteristic similar to that used in the above test examples 8 to 10 was employed, while as carrier, there was used magnetic carrier prepared by sufficiently mixing and grinding, with a Henschel mixer, 100 weight parts of polyester resin (softening point 123° C., glass transition point 65° C., AV 23, OHV 40) 500 weight parts of inorganic magnetic powder (EPT-1000, referred to earlier) and 2 weight parts of carbon black (MA#8, referred to earlier) and then, melting and kneading the mixture by an extruding kneader set at temperatures of 180° C. at a cylinder portion and at 170° C. at a cylinder head portion for subsequent cooling and pulverization by a jet mill, and thereafter, classifying the fine particles through employment of a classifier to obtain the magnetic carrier with an average particle diameter of 55 μm.

TEST EXAMPLE 13

In this Test example 13, the developing apparatus D16 for the sixteenth embodiment as shown in FIG. 27(A) was employed.

For the toner, the toner of a negative charging nature similar to that used in the Test example 11 was used, while for the carrier, magnetic carrier similar to that used in the above test example 12 was adopted.

COMPARATIVE EXAMPLES 5 to 7

Subsequently, for comparison with the results in the above test examples 8 to 13, charge amounts of toner supplied onto the developing sleeve were measured through employment of developing apparatus in the embodiments, as the comparative examples 5 to 7, with the electric field curtain device being arranged not to function.

In the comparative example 5, the positive charging characteristic toner similar to that employed in the test examples 8 to 10 was used and in the comparative example 6, the negative charging characteristic toner similar to that as employed in the test example 11 was adopted, while in the comparative example 7, the positive charging characteristic toner and carrier similar to those as used for the test example 12 was employed.

Thus, with respect to the test examples 8 to 13 and the comparative examples 5 to 7, charge amounts of toner supplied onto the respective developing sleeves were measured after 20 seconds, 1 minute, 30 minutes, and 2 hours respectively.

The results of the above measurements are shown in Table 3 below.

TABLE 3

| | Toner charge amount [μC/g] | | | |
|---|---|---|---|---|
| | 20 sec. | 1 min. | 30 min. | 2 hours |
| Test ex. 8 | +15.0 | +16.5 | +18.0 | +18.0 |
| Test ex. 9 | +19.5 | +22.8 | +24.1 | +25.3 |
| Test ex. 10 | +14.2 | +18.2 | +19.5 | +19.7 |
| Test ex. 11 | −15.5 | −18.0 | −20.5 | −20.4 |
| Test ex. 12 | +12.2 | +14.0 | +15.0 | +15.1 |
| Test ex. 13 | −12.7 | −14.3 | −16.4 | −16.3 |
| Comp. ex. 5 | +8.5 | +12.1 | +15.6 | +14.0 |
| Comp. ex. 6 | −9.6 | −15.3 | −18.1 | −15.9 |
| Comp. ex. 7 | +9.6 | +10.3 | +12.7 | +12.1 |

As is seen from the above results, the arrangements, in the respective test examples 8 to 13 employing the developing apparatuses of the embodiments according to the present invention are rapidly increasing in the rising speed of charging of toner as compared with those of the comparative example 5 to 7 with the charge amounts thereafter being stabilized in a proper range as compared with those of the comparative examples.

As described so far, in the developing apparatuses of the embodiments according to the present invention, when the developing material slightly charged by the contact and friction at the contact charging section, is supplied to the preliminary charging section, this function acts as a trigger, and by the action of the above electric field curtain provided at the preliminary charging section, the developing material is to be preliminarily charged to the uniform and proper charge amount by the action of said electric field curtain.

Thus, of the developing material charged at the preliminary charging section, the developing material insufficient in the charge amount is removed at the charge amount selecting section, and only the developing material charged by the proper amounts is selected to be led to the charged particulate material transport section so as to be further transported to the developing side by the charge particulate material transport section.

As a result, in the developing apparatuses of the present invention, the developing material is charged to the proper charge amount quickly and uniformly for the improvement of the response characteristic of the developing apparatus, while owing to the fact that only the developing material having the proper charge amount is supplied to the developing side, disadvantages in the conventional developing apparatuses such as fogging in the images, scattering of toner, etc. have been eliminated.

EMBODIMENT 17

Figure 28:
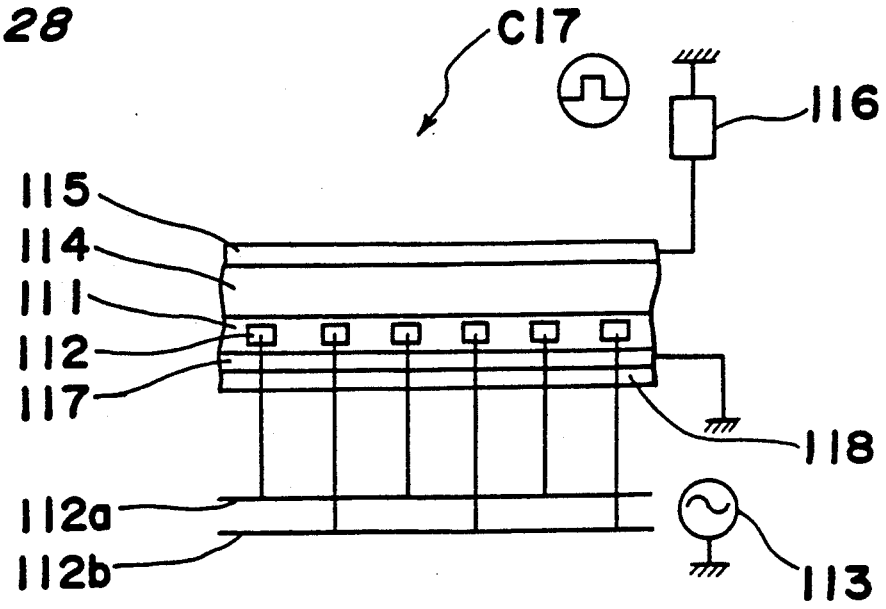
FIG. 28 is a schematic side sectional view of an electric field curtain device C17 according to a seventeenth embodiment of the present invention.

Referring further to FIG. 28, there is shown an electric field curtain device C17 according to a seventeenth embodiment of the present invention, which generally includes a thin film insulating layer 111 made of an insulative material, a plurality of electrodes 112 provided within said thin film insulating layer 111, with said electrodes 112 being alternately divided into two electrode groups 112*a* and 112*b*, to which alternating voltages deviated in phase by $\pi/2$ are applied from a two phase alternating voltage source 113 to form the non-uniform electric field row, a charge transport layer 114 containing an electric charge transport material corresponding to the charging polarity of a particulate material such as toner or the like and applied onto said thin film insulating layer 111 provided with the electrodes 112, a first conductive layer 115 provided on the upper surface of said charge transport layer 114 and adapted to be applied with a pulse bias voltage from a pulse power source 116, a second conductive layer 117 similar to said first conductive layer 115 and provided on the under surface of said thin film insulating layer 111 so as to be grounded, and, another insulating base layer 118 further applied over the under surface of said conductive layer 117.

For the materials to form the above first and second conductive layers 115 and 117, conductive materials such as chromium, aluminum, gold, copper, platinum, ITO (Indium Tin Oxide), etc. may be employed. For the formation of these conductive layers 115 and 117, sputtering, vacuum deposition or the like may be adopted, but from the view points of bonding strength, durability, etc., sputtering is preferable.

Figure 29:
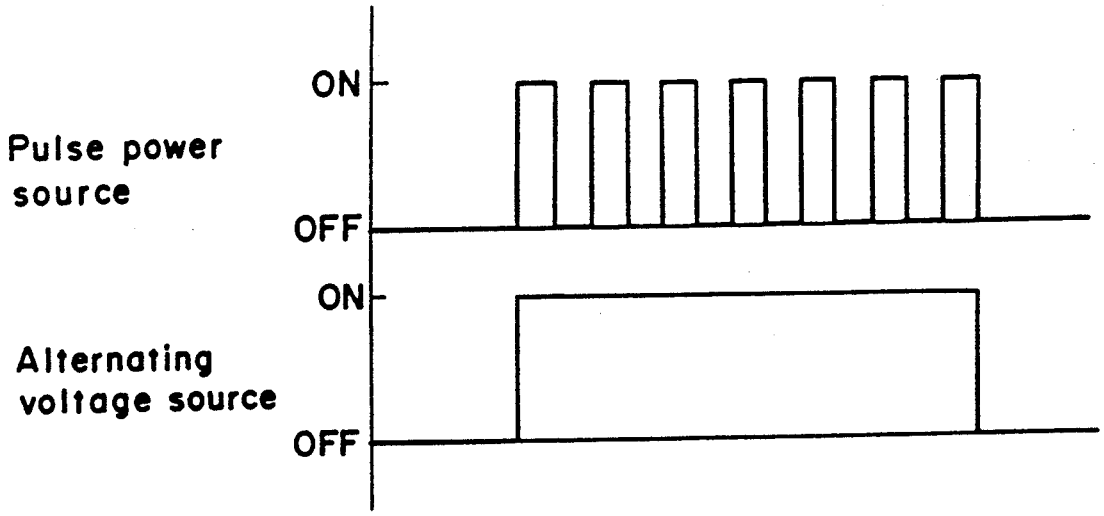
FIG. 29 is a timing-chart showing timing for operation of the electric field curtain device of the embodiment of FIG. 28.

In the electric field curtain device C17 of the above embodiment, for transferring a particulate material such as toner or the like, as shown in FIG. 29, the pulse bias voltage is applied to the first conductive layer 115 from the pulse bias voltage source 116 to cause the electric field to act on the charge transport layer 114, while the two phase alternating voltage source 113 is turned on to inject the carrier to the charge transport layer 114 from the electrodes 112 provided in said thin film insulating layer 111, thereby to lead the carrier to said first conductive layer 115 through the charge transport layer 114, and also, to cause the non-uniform electric field row to act by the two electrode groups 112*a* and 112*b*.

Meanwhile, counter-charge of the charge injected into the charge transport layer 114 from the electrodes 112 provided in the thin film insulating layer 111 as described above, is arranged to leak through the second conductive layer 117 provided below said thin film insulating layer 111.

Thus, when the particulate member such as toner or the like contacts the surface of the first conductive layer 115, such particulate material is instantly and strongly charged through contact by the carrier led into the first conductive layer 115 as described above so as to function as a trigger, and thus, by the action of the electric field curtain, the particulate material such as toner or the like is quickly charged uniformly at a proper charge amount for transportation.

Figure 30:
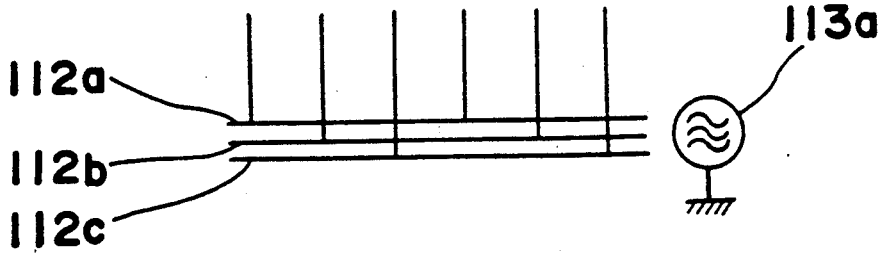
FIG. 30 is a diagram showing a modification in which three-phase alternating voltage is applied to the curtain device of FIG. 28.

It is to be noted here that, in the electric field curtain device C17 for the above embodiment, although the plurality of electrodes 112 provided with the thin film insulating layer 111 are divided into the two electrode groups 112*a* and 112*b* so as to be respectively applied with alternating voltages deviated in phase by $\pi/2$ from the two phase alternating voltage source 113, the arrangement may be, for example, so modified as shown in FIG. 30, that the electrodes 112 are divided into three electrode groups 112*a*, 112*b* and 112*c* respectively applied with alternating voltages deviated in phase by $\frac{2}{3}\pi$, from a three phase alternating voltage source 113*a* of the Y-connection, thereby to form the travelling wave non-uniform electric field row.

EMBODIMENT 18

Figure 31:
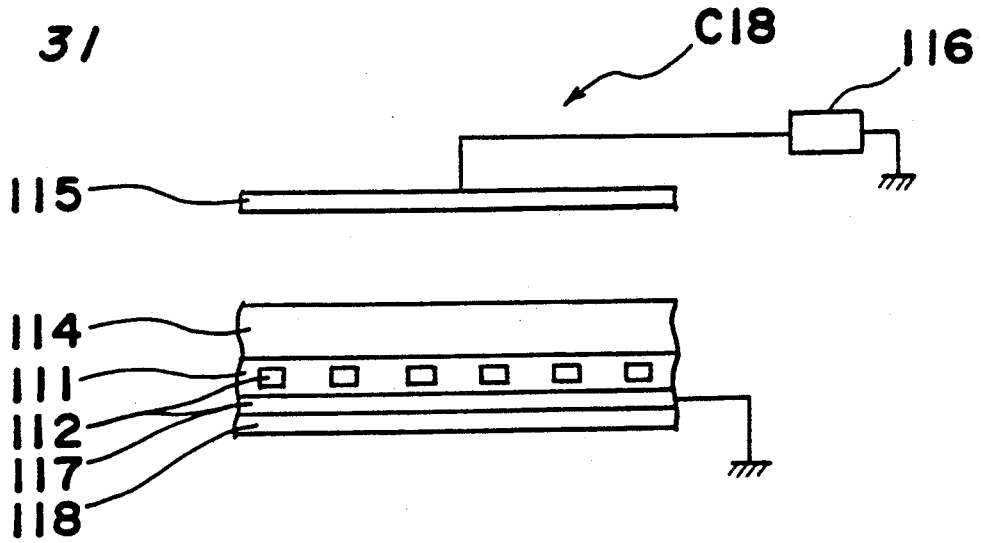
FIG. 31 is a schematic side sectional view of an electric field curtain device C18 according to an eighteenth embodiment of the present invention.

In an electric field curtain device C18 in an eighteenth embodiment, as shown in FIG. 31, it is so modified that the first conductive layer 115 described as provided on the upper surface of the charge transport layer 114 is disposed above said charge transport layer in a position spaced therefrom, thereby to charge the particulate material such as toner or the like between the first conductive layer 115 and the charge transport layer 114 for transportation.

Since other construction of the curtain device C18 is exactly the same as that of the curtain device C17 referred to above, detailed description thereof is abbreviated here for brevity.

EMBODIMENT 19

Figure 32:
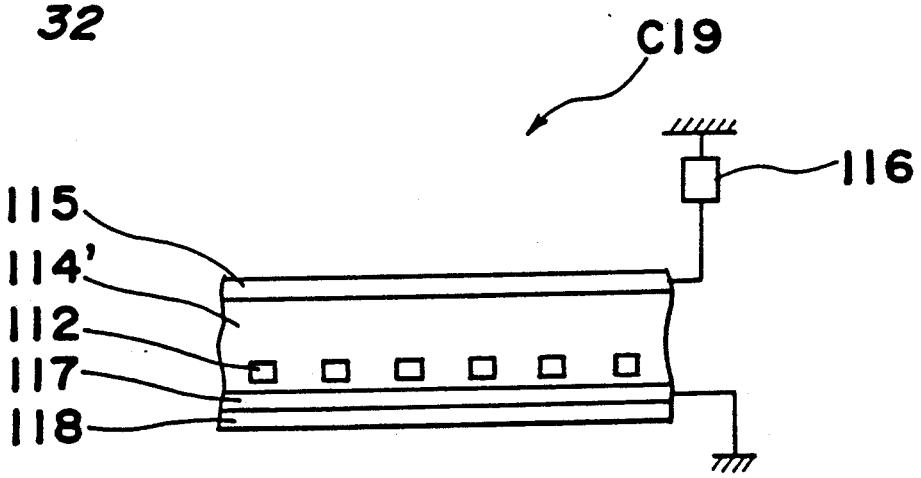
FIG. 32 is a schematic side sectional view of an electric field curtain device C19 according to a ninteenth embodiment of the present invention.

In an electric field curtain device C19 for this embodiment, as illustrated in FIG. 32, it is so modified that the thin film insulating layer 111 is dispensed with, while a layer having a high electrical resistance over $10^{10}\Omega\cdot$cm is employed for the charge transport layer 114', with the respective electrodes 112 being provided within said charge transport layer 114'.

Since other construction of the curtain device C19 is generally similar to that of the curtain device C17 referred to earlier, detailed description thereof is abbreviated here for brevity.

EMBODIMENT 20

Figure 33:
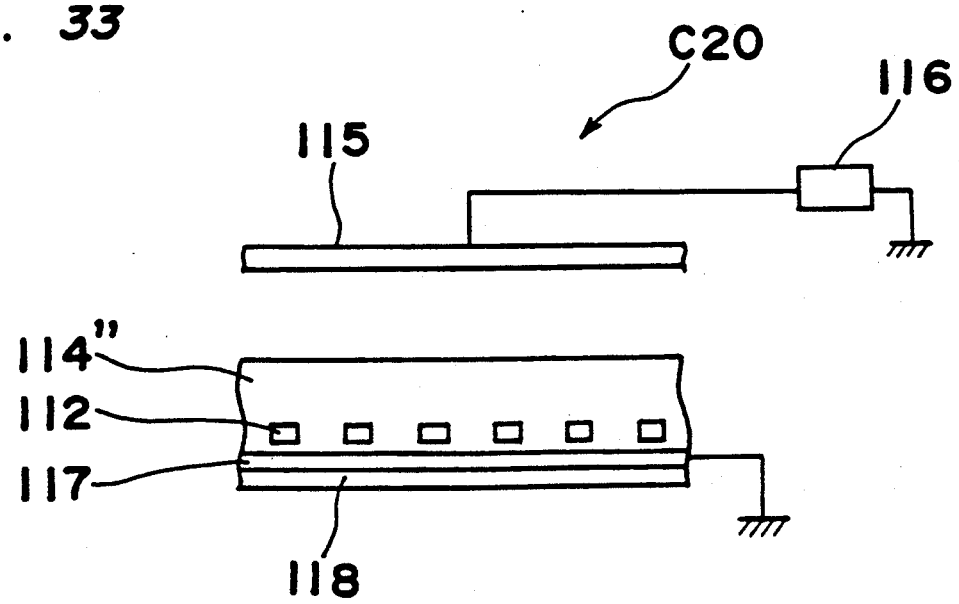
FIG. 33 is a schematic side sectional view of an electric field curtain device C20 according to a twentieth embodiment of the present invention.

In an electric field curtain device C20 for this embodiment, as shown in FIG. 33, the first conductive layer 115 is provided in a position above and spaced from the charge transport layer 114 so as to charge the particulate material such as toner or the like between said layers 115 and 114 for transportation in the similar manner as in the curtain device C18 for the eighteenth embodiment, while the charge transport layer 114'' having a high electrical resistance over $10^{10}\Omega\cdot$cm is adopted, with the thin film insulating layer 111 removed as in the curtain device C19 for the previous embodiment, and the respective electrodes 112 are provided in this charge transport layer 114".

EMBODIMENT 21

Figure 34:
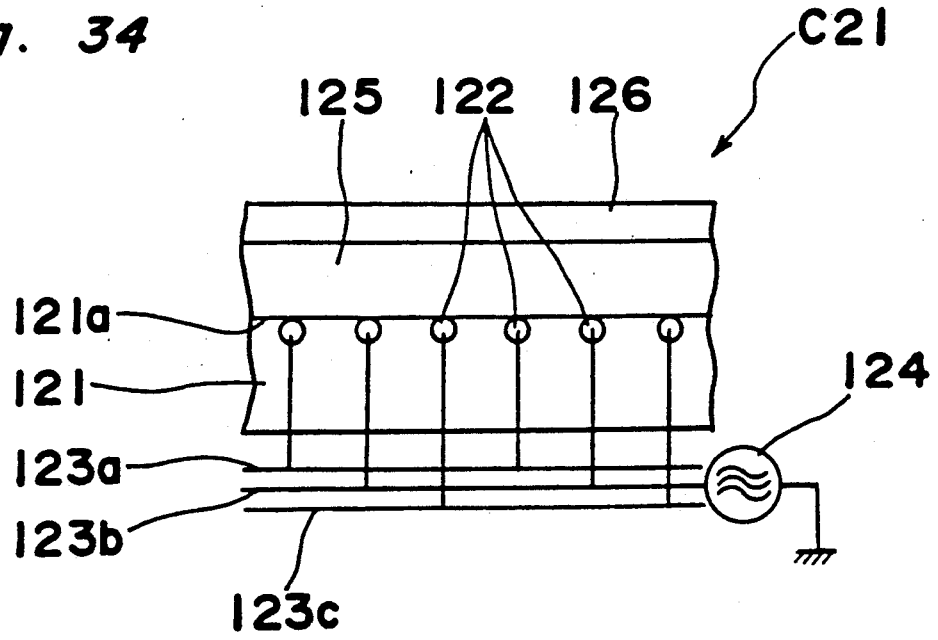
FIG. 34 is a schematic side sectional view of an electric field curtain device C21 according to a twentyfirst embodiment of the present invention.

In an electric field curtain device C21 for a twenty-first embodiment, as shown in FIG. 34, a plurality of electrodes 112 are provided in a dielectric layer 121 made of an insulative material, with part of each electrode 122 being exposed from the upper surface 121*a* of said dielectric layer 121.

Every two electrodes 122 are sequentially connected to three lead wires 123*a*, 123*b* and 123*c* to divide the electrodes 122 into three groups, while the respective lead wires 123*a*, 123*b* and 123*c* are connected to a three phase alternating voltage source 124 of the Y-connection.

Moreover, on the upper surface 121*a* of the dielectric layer 121 from which the respective electrode 122 are partially exposed, a piezoelectric element 125 is provided to contact with the electrodes 122, with an amorphous carbon film 126 being further formed on said piezoelectric element 125.

In the electric field curtain device C21 as described above, upon application of alternating voltages deviated in phase by $\frac{2}{3}\pi$ to the respective electrode groups 122 through the lead wires 123*a*, 123*b* and 123*c* from the voltage source 124, the travelling wave alternating non-uniform electric field row is formed, while the piezoelectric element 125 provided on the dielectric layer 121 starts vibrating.

Thus, when the particulate material such as toner or the like contacts the amorphous carbon film 126 provided on the surface of this electric field curtain device C21, the particulate material is instantly strongly charged by the contact since the amorphous carbon film 126 has a very high contact electric field, and this function acting as a trigger, the particulate material comes to be transported by the action of the above travelling wave alternting non-uniform electric field and the vibration of the piezoelectric element 125.

Figure 35:
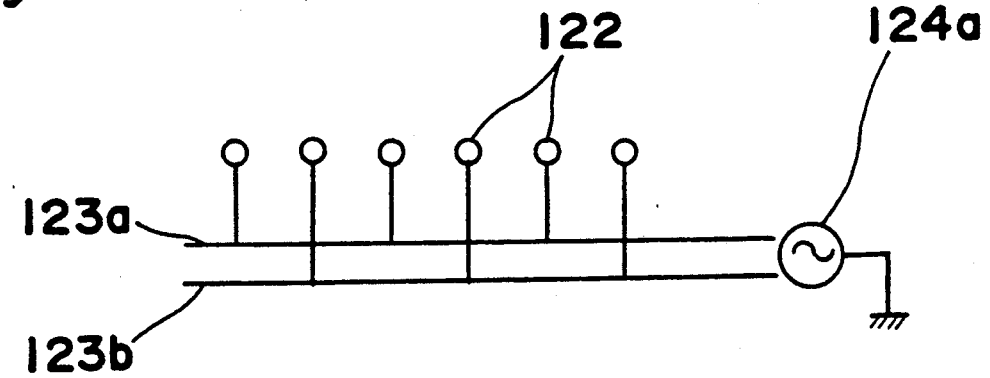
FIG. 35 is a diagram showing an example in which a standing wave alternating non-uniform electric field row is to be formed in the electric field curtain device for the embodiment of FIG. 34.

It is to be noted here that, in the above electric field curtain device C21, although the three phase alternating voltage source 124 is employed to form the travelling wave non-uniform electric field, the arrangement may, for example, be so modified that as shown in FIG. 35, every other electrodes 122 are sequentially connected to two lead wires 123*a* and 123*b* so as to divide the electrodes into two groups, and by connecting these two lead wires 123*a* and 123*b* to a two phase alternating voltage source 124*a* or by using a single phase power source, the standing wave alternating non-uniform electric field row may be formed.

Subsequently, description will be made with respect to a specific case where the electric field curtain devices as described above are manufactured and applied to developing apparatuses for an electrophotographic copying machine.

Figure 36:
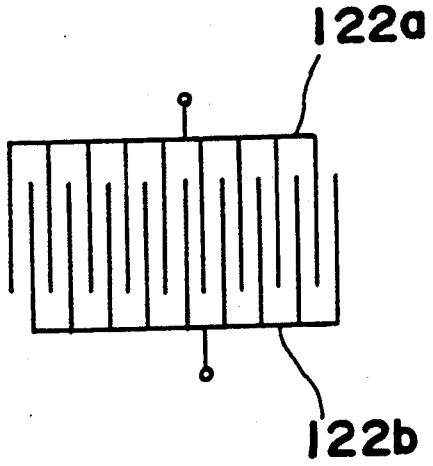
FIG. 36 is a top plan view showing one example of electrodes employed for the electric field curtain device of the present invention.

In this case, a pair of comb-type electrodes 122*a* and 122*b* made of copper (FIG. 36) are provided on the surface 121*a* of the dielectric layer 121 made, for example, of polyimide, with a thickness of 0.5 mm, so as to confront each other, with part of said electrodes being exposed from the surface 121*a* of said dielectric layer 121. Here, each of the comb-type electrodes 122*a* and 122*b* is so formed as to have a thickness of 10 μm, line width of 0.9 mm, with a pitch or interval between the electrodes 122*a* and 122*b* being set at 1.5 mm.

Thus, on the upper surface 121*a* of the dielectric layer 121 provided with the comb-type electrode as described above, the piezoelectric element 125 having a film thickness of 0.5 mm was applied under pressure as shown in the embodiment of FIG. 34, and thereafter, a bonding agent was inserted into a gap between the surface 121*a* of the dielectric layer 121 and the piezoelectric element 125 for molding by press work.

Figure 37:
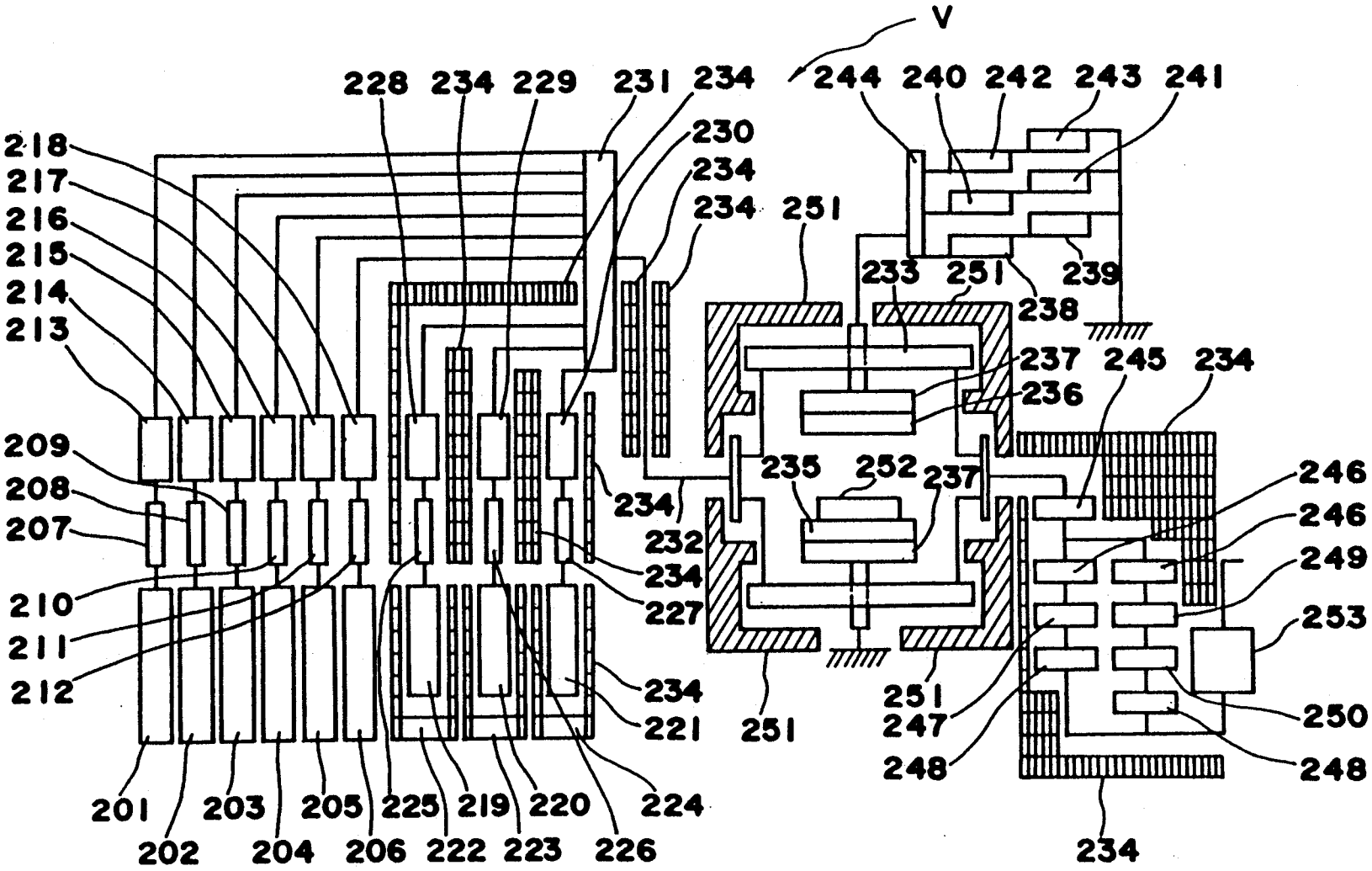
FIG. 37 is a schematic diagram showing one example of a plasma CVD device employed for manufacture of the electric field curtain device according to the present invention.

Furthermore, on the surface thus formed with the piezoelectric element 125, a plasma organic polymer film was formed through employment of a plasma CVD unit V as shown in FIG. 37.

In the plasma CVD unit V in FIG. 37, raw materials in a state of gaseous phase at ordinary temperatures and carrier gas are tightly enclosed in first to sixth tanks 201 to 206, and first to sixth control valves 207 to 212 and first to sixth flow rate controllers 213 to 218 corresponding thereto are connected to the respective tanks 201 to 206.

Meanwhile, in first to third containers 219 to 221, raw materials in a state of liquid phase or solid state at ordinary temperatures are enclosed, and in order to vaporize the respective raw materials contained in these containers 219 to 221, first to third temperature controllers 222 to 224 corresponding to the respective containers 219 to 221 are provided for said containers 219 to 221. Moreover, to the containers 219 to 221, seventh to ninth regulating valves 225 to 227 and seventh to ninth flow rate controllers 228 to 230 corresponding thereto are respectively connected.

It is so arranged that the gases are mixed in a mixer 231, and then, fed into a reaction chamber 233 through a main pipe 232. It is to be noted that, for the piping in the course of the pipe line, piping heaters 234 are disposed for heating at proper portions of the piping so that the gas resulting from vaporization of the raw material compounds which were in a state of liquid phase or solid state may not be condensed.

Furthermore, in the reaction chamber 233 also, reaction chamber heaters 251 are disposed therearound for heating to avoid condensation of the gases obtained by evaporating the raw material compounds which were in the state of liquid phase or solid state at ordinary temperatures.

In the above reaction chamber 233, a ground electrode 235 and a power impressing electrode 236 are disposed to confront each other, while electrode heaters 237 are respectively provided on these electrodes 235 and 236 so as to be heated thereby.

To the above power impressing electrode 236, there are connected a high frequency power source 239 provided with a high frequency power matching unit 238, a low frequency power source 241 provided with a low frequency power matching unit 240, and a d.c. power source 243 provided with a low-pass filter 242, through a connection selecting switch 244, so that electric power having different frequencies as properly selected by the connection selecting switch 244 may be applied.

Meanwhile, for adjusting the pressure within said reaction chamber 233, there is provided a pressure control valve 245, and the reduction of pressure within the reaction chamber 233 is arranged to be effected by a diffusion pump 247 and oil rotary pumps 248 through discharge system selecting valves 246, or by a cooling removing unit 249, a mechanical booster pump 250 and the oil rotary pumps 248. It is to be noted here that exhaust gas is adapted to be discharged into atmosphere after further having been made non-noxious and safe through a proper removing unit 253.

Furthermore, in these exhaust system pipings also in order to prevent the gas formed by vaporization of the raw material compounds in a liquid phase or a solid state, from being condensed on the way, the piping heaters 234 are provided at proper positions for heating.

EMBODIMENT 22

In this embodiment, for forming a plasma organic polymerized film over the piezoelectric element 125 formed on the surface 121*a* of the dielectric layer 121 as described earlier, a substrate 252 in which the piezoelectric element 125 is formed on the surface 121*a* of the dielectric layer 121 was set on the ground electrode 235 provided in said reaction chamber 233.

Thereafter, the interior of the reaction chamber 233 was reduced in pressure through the pressure control valve 245 to achieve a high vacuum state in the order of $10^{-6}$ Torr or thereabout, and thereafter, the first second and third control valves 207,208 and 209 are opened, and hydrogen gas from the first tank 201, 1,3-butadiene gas from the second tank 202, and ethylene fluoride gas from the third tank 203 were respectively adjusted at output pressure of 1.0 kg/cm$^2$ and caused to flow into the corresponding first, second and third flow rate controllers 213, 214 and 215.

Thus, by adjusting scales of the respective flow rate controllers 213, 214 and 215, setting was made to achieve the flow rate of hydrogen gas at 40 sccm, that of 1,3-butadiene gas at 30 sccm, and that of ethylene fluoride gas at 60 sccm, and these gases were introduced into the mixer 231 for mixing so as to be subsequently caused to flow into the reaction chamber 233.

After the state of in-flow of the respective gases introduced in the above described manner was stabilized, the pressure regulating valve 245 was adjusted to achieve the pressure within the reaction chamber 233 at 0.9 Torr.

On the other hand, the substrate 252 set on the ground electrode 235 in the manner as described earlier was preliminarily heated up to 100° C., and after stabilization of the gas flow rate and pressure, the high frequency power source 239 preliminarily connected to the power impressing electrode 236 by the connection selecting switch 244 was turned on, and from said high frequency power source 239, electric power of 120 W was applied to the power impressing electrode 236 at a frequency of 100 KHz for effecting the plasma polymerization reaction for about two minutes, and thus, a plasma organic polymerized film of 0.32 μm in thickness containing fluorine was formed over the piezoelectric element 125 of the substrate 252.

After formation of the plasma organic polymerized film containing fluoride in the above described manner, the electric power impression form the above high frequency power source 239 was suspended, while the pressure control valve 245 was opened to sufficiently discharge the gas within the reaction chamber 233, and thereafter, the electric field curtain device formed, on its surface, with the plasma organic polymerized film containing fluorine, was taken out.

It is to be noted here that, as a result of CHN quantitative analysis conducted on the plasma organic polymerised film containing fluorine and obtained in the manner as described above, the amount of contained hydrogen atoms was at about 34 atomic % with respect to the total amounts of carbon atoms and hydrogen atoms, and further, based on Auger analysis, the amount of contained halogen atoms, i.e. the amount of fluorine atoms was at 7.1 atomic

EMBODIMENT 23

In this embodiment, hydrogen gas was employed as a carrier gas, while propylene gas was used for a raw material gas, with the flow rate of hydrogen gas set at 100 sccm, and that of propylene gas at 45 sccm, while electric power of 100 W at a frequency of 500 KHz was applied to the power impressing electrode 236 for about two minutes, and with other conditions being held to be similar to those in the embodiment 22, a plasma organic polymerized film in a thickness of 0.9 μm was formed.

It is to be noted here that the amount of hydrogen atoms in the plasma organic polymerized film thus obtained was at about 47 atomic %.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developing apparatus for developing an electrostatic latent image, which comprises an electrostatic latent image holding member for holding an electrostatic latent image, a developing material support member provided to confront said electrostatic latent image holding member, and an electric field curtain generating means which functions as a developing material supply means for supplying the developing material to said developing material support member, and also causes an electric field curtain force in a form of a travelling wave travelling in terms of time, to act on the developing material.

2. A developing apparatus as claimed in claim 1, wherein said electric field curtain generating means comprises at least a pair of electrodes insulated from each other, and means for impressing alternating current of at least more than two phases across said electrodes.

3. A developing apparatus as claimed in claim 1, wherein said developing material supply means includes a charging means for charging the developing material.

4. A developing apparatus as claimed in claim 3, wherein said charging means is a corona discharge generating means.

5. A developing apparatus for developing an electrostatic latent image comprising:

an electrostatic latent image holding member for holding an electrostatic latent image, a developing material support member provided to confront said electrostatic latent image holding member, and an electric field curtain generating means which functions as a developing material supply means for supplying the developing material to said developing material support member, and also causes an electric field curtain force in a form of a travelling wave travelling in terms of time, to act on the developing material such that said electric field curtain generating means further comprises at least a pair of electrodes insulated from each other, said electrodes being covered by a charged transport layer for moving charged carrier injected from said electrodes therethrough, and means for impressing alternating current of at least more than two phases across said electrodes.

6. A developing apparatus for developing an electrostatic latent image comprising:

an electrostatic latent image holding member for holding an electrostatic latent image, a developing material support member provided to confront said electrostatic latent image holding member, and an electric field curtain generating means which functions as a developing material supply means for supplying the developing material to said developing material support member, and also causes an electric field curtain force in a form of a travelling wave travelling in terms of time, to act on the developing material, said electric field curtain generating means further comprises at least a pair of electrodes insulated from each other, said electrodes being covered by a piezoelectric element and an amorphous carbon film for coating said piezoelectric element, and means for impressing alternating current of at least more than two phases across said electrodes.

7. A developing apparatus for developing an electrostatic latent image comprising:

an electrostatic latent image holding member for holding an electrostatic latent image, a developing material support member provided to confront said electrostatic latent image holding member, and an electric field current generating means which functions as a developing material supply means for supplying the developing material to said developing material support member, and also causes an electric field curtain force in a form of a travelling wave travelling in terms of time, to act on the developing material, wherein said developing material supply means includes means for collecting the developing material having a charge amount less than a predetermined charge amount.

8. A developing apparatus for developing an electrostatic latent image, which comprises an electrostatic latent image holding member for holding an electrostatic latent image, a developing material support member provided to confront said electrostatic latent image holding member and driven for rotation, and a developing material supply means having an opening portion at least at its on portion to confront said developing material support member, and also, a plurality of insulated electrodes provided along a direction towards said opening, wherein means for impressing alternating voltage of at least more than two phases is connected across the neighboring ones of said electrodes for causing an alternating electric field to act, as an electric field curtain force in a form of a travelling wave travelling in terms of time towards said opening.

9. A developing apparatus as claimed in claim 8, wherein means for causing alternating electric field to act on the opening portion is provided in the vicinity of said opening portion.

10. A developing apparatus for developing an electrostatic latent image comprising:

an electrostatic latent image holding member for holding an electrostatic latent image, a developing material support member provided to confront said electrostatic latent image holding member and driven for rotation, and a developing material supply means having an opening portion to confront said developing material support member, and also, a plurality of insulated electrodes provided along a direction towards said opening, wherein means for impressing alternating voltage of at least more than two phases is connected across the neighboring ones of said electrodes for causing an alternating electric field to act, as an electric field curtain force in a form of a travelling wave travelling in terms of time towards said opening wherein said alternating voltage impressing means is arranged to lower the value of the alternating voltage to be impressed to the electrodes as the electrodes are located nearer said opening portion.

11. A developing apparatus for developing an electrostatic latent image comprising:

an electrostatic latent image holding member for holding an electrostatic latent image, a developing material support member provided to confront said electrostatic latent image holding member and driven for rotation, and a developing material supply means having an opening portion to confront said developing material support member, and also, a plurality of insulated electrodes provided along a direction towards said opening, wherein means for impressing alternating voltage of at least more than two phases is connected across the neighboring ones of said electrodes for causing an alternating electric field to act, as an electric field curtain force in a form of a travelling wave travelling in terms of time towards said opening wherein a piezoelectric element is provided in the vicinity of said opening portion.

12. A developing apparatus which comprises a contact charging section for causing an uncharged developing material to be electrically charged through contact, a preliminary charging section for uniformly subjecting the developing material led from said contact charging section to preliminary electrical charging, a charge amount selecting section for selecting the developing material electrically charged in a proper amount by eliminating the developing material improperly charged in the developing material preliminarily charged in said preliminary charging section, and a charged particulate material transport section for transporting the developing material charged by the proper amount and selected by the charge amount selecting section, toward the developing side, and further an electric field curtain device provided at least at said preliminary charging section.

13. A developing apparatus for developing an electrostatic latent image comprising:

an electrostatic latent image holding member for holding an electrostatic latent image, a developing material support member provided to confront said electrostatic latent image holding member, and an electric field curtain generating means which functions as a developing material supply means for supplying the developing material to said developing material support member, and also causes an electric field curtain force in a form of a travelling wave travelling in terms of time, to act on the developing material, such that said electric field curtain generating means further comprises at least a pair of electrodes insulated from each other, and means for impressing alternating current of at least more than two phases across said electrodes.

* * * * *